US008463549B1

(12) United States Patent
Selman et al.

(10) Patent No.: US 8,463,549 B1
(45) Date of Patent: Jun. 11, 2013

(54) METHOD FOR GEOSTEERING DIRECTIONAL DRILLING APPARATUS

(75) Inventors: Thomas H. Selman, Midland, TX (US); Matthew J. Jennings, Midland, TX (US)

(73) Assignee: Selman and Associates, Ltd., Midland, TX (US)

( * ) Notice: Subject to any disclaimer, the term of this patent is extended or adjusted under 35 U.S.C. 154(b) by 327 days.

(21) Appl. No.: 12/879,708

(22) Filed: Sep. 10, 2010

(51) Int. Cl.

| | |
|---|---|
| ***G01V 3/18*** | (2006.01) |
| ***G01V 3/17*** | (2006.01) |
| ***G01V 3/20*** | (2006.01) |
| ***G06F 3/01*** | (2006.01) |

(52) U.S. Cl.
USPC ..... 702/9; 702/11; 702/12; 702/179

(58) Field of Classification Search
USPC ..... 702/6, 9, 11, 12, 27, 34, 172, 179, 702/182; 175/45; 299/5; 703/10
See application file for complete search history.

(56) References Cited

U.S. PATENT DOCUMENTS

| | | | | |
|---|---|---|---|---|
| 2,752,777 | A | 10/1950 | Jacobs et al. | |
| 2,752,776 | A | 4/1954 | Kapff et al. | |
| 4,272,258 | A | 6/1981 | Shifflett | |
| 4,358,298 | A | 11/1982 | Ratcliff | |
| 4,414,651 | A | 11/1983 | Buckner | |
| 4,565,086 | A | 1/1986 | Orr, Jr. | |
| 4,616,321 | A | 10/1986 | Chan | |
| 4,670,139 | A | 6/1987 | Spruiell et al. | |
| 4,831,559 | A | 5/1989 | Miller | |
| 5,058,674 | A | 10/1991 | Schultz et al. | |
| 5,199,509 | A | 4/1993 | Wright et al. | |
| 5,237,539 | A | 8/1993 | Selman | |
| 5,329,811 | A | 7/1994 | Schultz et al. | |
| 5,648,603 | A | 7/1997 | Hason | |
| 5,869,343 | A | 2/1999 | Handschuck et al. | |
| 6,073,709 | A | 6/2000 | Hensley | |
| 6,496,309 | B1 | 12/2002 | Bilton et al. | |
| 6,505,523 | B1 | 1/2003 | Taylor et al. | |
| 6,546,818 | B2 | 4/2003 | Taylor et al. | |
| 6,609,433 | B2 | 8/2003 | Taylor et al. | |
| 6,666,099 | B2 | 12/2003 | Taylor | |
| 7,099,003 | B2 | 8/2006 | Saptari et al. | |
| 7,219,541 | B2 | 5/2007 | DiFoggio et al. | |
| 7,735,935 | B2 * | 6/2010 | Vinegar et al. | 299/5 |
| 7,844,400 | B1 | 11/2010 | Selman et al. | |
| 7,957,903 | B1 | 6/2011 | Selman et al. | |
| 8,132,452 | B1 | 3/2012 | Selman et al. | |
| 8,145,462 | B2 * | 3/2012 | Foucault | 703/10 |
| 2007/0050154 | A1 | 3/2007 | Albahri | |
| 2009/0090555 | A1 * | 4/2009 | Boone et al. | 175/45 |

(Continued)

*Primary Examiner* — Marc Armand
*Assistant Examiner* — Felix Suarez
(74) *Attorney, Agent, or Firm* — Buskop Law Group, PC; Wendy Buskop

(57) ABSTRACT

A method for geosteering during directional drilling of a wellbore including a processor, a data storage, and client devices in communication with the processor through a network. The processor can receive data from directional drilling equipment and can present that data to users in an executive dashboard. Users can send data and/or commands to the directional drilling equipment. The executive dashboard can present a portion of interest in a stratigraphic cross section for user identification of the drill bit in the stratigraphic cross section, formations in the stratigraphic cross section, and other formation data. The method can be used to identify a projected path for the drill bit, import data, compute wellbore profiles and stratigraphic cross sections, plot actual drilling paths, overlay the actual drilling path onto the projected path, and present control buttons to the user.

30 Claims, 20 Drawing Sheets

U.S. PATENT DOCUMENTS

2010/0027004 A1 2/2010 Bonyuet et al.
2010/0089120 A1 4/2010 Hanson
2010/0175467 A1 7/2010 DiFoggio et al.
2011/0308391 A1 12/2011 DeGreeve et al.

* cited by examiner

FIGURE 4B

7

COMPUTER INSTRUCTIONS TO INSTRUCT THE PROCESSOR TO COMPUTE THE TRUE VERTICAL DEPTHS AS MEASURED AT THE PERPENDICULAR ANGLE FROM THE HORIZONTAL PLANE REPRESENTING THE SURFACE SURROUNDING THE WELL BORE USING MEASURED DEPTHS, INCLINATIONS, AND AZIMUTHS; TO PLOT THE TRUE VERTICAL DEPTHS VERSUS THE MEASURED DEPTHS OF THE DRILL BIT; AND TO PRESENT THE PLOTTED TRUE VERTICAL DEPTHS VERSUS THE MEASURED DEPTHS WITHIN THE WELLBORE PROFILE IN THE EXECUTIVE DASHBOARD — 618

COMPUTER INSTRUCTIONS TO INSTRUCT THE PROCESSOR TO PRESENT A FIRST SPEED CONTROL BUTTON IN THE EXECUTIVE DASHBOARD TO CONTROL A RATE OF ADJUSTMENT FOR CONTROL BUTTONS, AND A SECOND SPEED CONTROL BUTTON TO CONTROL A RATE OF ADJUSTMENT FOR CONTROL BUTTONS — 620

COMPUTER INSTRUCTIONS TO INSTRUCT THE PROCESSOR TO TRANSMIT AN ALARM IF CONTINUED DRILLING IN A FORMATION: WILL VIOLATE A PERMIT, WILL POSE A SAFETY HAZARD, WILL BE AN ECONOMIC HAZARD, OR COMBINATIONS THEREOF — 622

COMPUTER INSTRUCTIONS TO INSTRUCT THE PROCESSOR TO SUPERIMPOSE THE PROJECTED PATH FOR THE DRILL BIT OVER A FORMATION STRUCTURE MAP TO DETERMINE FAULTS THROUGH WHICH THE PROJECTED PATH WILL PASS — 624

COMPUTER INSTRUCTIONS TO INSTRUCT THE PROCESSOR TO SUPERIMPOSE THE PROJECTED PATH FOR THE DRILL BIT OVER THE STRATIGRAPHIC CROSS SECTION TO DETERMINE FORMATIONS THROUGH WHICH THE PROJECTED PATH WILL PASS — 626

COMPUTER INSTRUCTIONS TO INSTRUCT THE PROCESSOR TO FORM A REPORT OF THE PROJECTED PATH AND THE ACTUAL DRILLING PATH, AND TO PRESENT THE REPORT OF THE PROJECTED PATH AND THE ACTUAL DRILLING PATH IN THE EXECUTIVE DASHBOARD TO BE VIEWED IN REAL-TIME BY A PLURALITY OF USERS SIMULTANEOUSLY — 628

COMPUTER INSTRUCTIONS TO INSTRUCT THE PROCESSOR TO FORM A REPORT OF PAST DRILLING DATA AND PLANNED DRILLING ACTIONS ASSOCIATED WITH THE EXECUTIVE DASHBOARD — 630

COMPUTER INSTRUCTIONS TO INSTRUCT THE PROCESSOR TO DISPLAY IN THE EXECUTIVE DASHBOARD AN ACTUAL LOCATION OF THE DRILL BIT ON THE ACTUAL DRILLING PATH FOR INSTANTANEOUS IDENTIFICATION OF THE DRILL BIT DURING HORIZONTAL DRILLING — 632

COMPUTER INSTRUCTIONS TO INSTRUCT THE PROCESSOR TO USE A SURFACE ELEVATION OR A ROTARY TABLE BUSHING ELEVATION OF A SURFACE FOR A START OF A BORE HOLE AND AT LEAST ONE OFFSET/TYPE TOPS OF THE PROJECTED FORMATION TO GENERATE THE GEOLOGICAL PROGNOSIS — 634

COMPUTER INSTRUCTIONS TO INSTRUCT THE PROCESSOR TO USE TYPE LOG TOPS FROM A VERTICAL WELL PROXIMATE THE WELLBORE TO CALCULATE THICKNESSES OF FORMATIONS, THICKNESSES OF ROCK BETWEEN FORMATIONS, OTHER GEOLOGICAL FEATURES, OR COMBINATIONS THEREOF — 636

FIGURE 4C

7

COMPUTER INSTRUCTIONS TO INSTRUCT THE PROCESSOR TO GENERATE THE PROJECTED PATH BY CALCULATING THE PROJECTED PATH USING A KICK OFF POINT, A BUILD RATE, A LANDING POINT, AND A TARGET ANGLE — 638

COMPUTER INSTRUCTIONS TO INSTRUCT THE PROCESSOR TO PROVIDE CORRELATION POINTS FOR AT LEAST ONE ACTUAL CURVE OR AT LEAST ONE POINT ALONG AN ACTUAL CURVE OF THE STRATIGRAPHIC CROSS SECTION, WHEREIN EACH CORRELATION POINT IS TIED TO A KNOWN TYPE LOG CURVE FOR CONFIRMING ACCURACY OF THE ACTUAL CURVE, ACCURACY OF A FIT OF THE ACTUAL CURVE TO THE KNOWN TYPE LOG CURVE, OR COMBINATIONS THEREOF — 640

COMPUTER INSTRUCTIONS TO INSTRUCT THE PROCESSOR TO PROVIDE CORRELATION POINTS FOR AT LEAST ONE ACTUAL CURVE OR AT LEAST ONE POINT ALONG AN ACTUAL CURVE OF THE STRATIGRAPHIC CROSS SECTION TO ALLOW THE USER TO THICKEN OR THIN EACH ACTUAL CURVE OF THE STRATIGRAPHIC CROSS SECTION TO FIT A KNOWN TYPE LOG CURVE — 642

COMPUTER INSTRUCTIONS TO INSTRUCT THE PROCESSOR TO PRESENT THE PROJECTED PATH IN THE EXECUTIVE DASHBOARD SIMULTANEOUSLY IN TWO DIMENSIONS AND IN THREE DIMENSIONS — 644

COMPUTER INSTRUCTIONS TO INSTRUCT THE PROCESSOR TO STORE DATA RECEIVED FROM THE DIRECTIONAL DRILLING EQUIPMENT WITHIN THE DATA STORAGE — 646

COMPUTER INSTRUCTIONS TO INSTRUCT THE PROCESSOR TO COMMUNICATE OVER A NETWORK AND TO IMPORT THE PLURALITY OF OFFSET/TYPE TOPS OF THE PROJECTED FORMATION THROUGH WHICH THE PROJECTED PATH WILL FOLLOW — 648

COMPUTER INSTRUCTIONS TO INSTRUCT THE PROCESSOR TO SAVE THE WELLBORE PROFILE IN THE DATA STORAGE — 650

COMPUTER INSTRUCTIONS TO INSTRUCT THE PROCESSOR TO TRANSMIT THE WELLBORE PROFILE TO THE DISPLAY — 652

COMPUTER INSTRUCTIONS TO INSTRUCT THE PROCESSOR TO COMPUTE A "DISTANCE TO NEXT FORMATION" USING THE MEASURED DEPTH FROM THE CURRENT FORMATION, AND PRESENT THE COMPUTED "DISTANCE TO NEXT FORMATION" TO THE USER WITHIN THE EXECUTIVE DASHBOARD — 654

COMPUTER INSTRUCTIONS TO INSTRUCT THE PROCESSOR TO USE AN ESTIMATED TRUE VERTICAL DEPTH OF THE NEXT FORMATION AND A KELLY BUSHING ELEVATION TO COMPUTE AN "ESTIMATED SUBSEA DEPTH OF NEXT FORMATION", AND PRESENT THE "ESTIMATED SUBSEA DEPTH OF NEXT FORMATION" TO THE USER IN THE EXECUTIVE DASHBOARD — 656

COMPUTER INSTRUCTIONS TO INSTRUCT THE PROCESSOR TO DETERMINE A "CURRENT DIP" — 658

COMPUTER INSTRUCTIONS TO INSTRUCT THE PROCESSOR TO CALCULATE A "CURRENT TRUE VERTICAL DEPTH", AND TO PRESENT THE "CURRENT TRUE VERTICAL DEPTH" IN THE EXECUTIVE DASHBOARD — 660

FIGURE 4D

7

COMPUTER INSTRUCTIONS TO INSTRUCT THE PROCESSOR TO PRESENT THE REPORTS TO THE USER IN ADDITION TO AND SIMULTANEOUSLY WITH THE EXECUTIVE DASHBOARD — 662

COMPUTER INSTRUCTIONS TO INSTRUCT THE PROCESSOR TO CONFIGURE THE EXECUTIVE DASHBOARD TO ALLOW USERS TO HIGHLIGHT PORTIONS OF THE WELLBORE PROFILE — 664

COMPUTER INSTRUCTIONS TO INSTRUCT THE PROCESSOR TO PLOT AN ACTUAL CURVE AND TO PLOT A TYPE LOG CURVE WITHIN THE SAME GRAPH FOR FITTING/CORRELATION OF THE ACTUAL CURVE TO THE TYPE LOG CURVE — 666

COMPUTER INSTRUCTIONS TO INSTRUCT THE PROCESSOR TO FORM A PLOT OF A PORTION OF THE ACTUAL CURVE WITHIN THE PORTION OF INTEREST IN THE STRATIGRAPHIC SECTION VERSUS THE TARGET RELATIVE DEPTH SCALE — 668

COMPUTER INSTRUCTIONS TO INSTRUCT THE PROCESSOR TO CALCULATE A CHANGE IN TRUE VERTICAL DEPTH DUE TO A DIP — 670

COMPUTER INSTRUCTIONS TO INSTRUCT THE PROCESSOR TO CALCULATE THE TRUE VERTICAL DEPTH AT THE STARTING MEASURED DEPTH FOR THE STRATIGRAPHIC SECTION USING THE ACTUAL SURVEY STORED IN THE DATA STORAGE — 672

COMPUTER INSTRUCTIONS TO INSTRUCT THE PROCESSOR TO CALCULATE THE TRUE VERTICAL DEPTH AT THE MEASURED DEPTH OF THE DATA POINT ALONG THE ACTUAL CURVE USING THE ACTUAL SURVEY WITHIN THE DATA STORAGE — 674

COMPUTER INSTRUCTIONS TO INSTRUCT THE PROCESSOR TO CALCULATE A CHANGE IN THE TRUE VERTICAL DEPTH DUE TO A CHANGE IN TRUE VERTICAL DEPTH IN THE ACTUAL SURVEY BY DETERMINING A DIFFERENCE BETWEEN THE TRUE VERTICAL DEPTH AT THE STARTING MEASURED DEPTH AND THE TRUE VERTICAL DEPTH AT THE MEASURED DEPTH AT THE DATA POINT ALONG THE ACTUAL CURVE — 676

COMPUTER INSTRUCTIONS TO INSTRUCT THE PROCESSOR TO CALCULATE A CHANGE IN TARGET RELATIVE DEPTH BY PERFORMING A SUMMATION OF THE CHANGE IN TRUE VERTICAL DEPTH DUE TO DIP AND THE CHANGE IN TRUE VERTICAL DEPTH DUE TO THE CHANGE IN TRUE VERTICAL DEPTH IN THE ACTUAL SURVEY — 678

COMPUTER INSTRUCTIONS TO INSTRUCT THE PROCESSOR TO CALCULATE AN "X" AXIS VALUE FOR THE PLOT OF THE PORTION OF THE ACTUAL CURVE WITHIN THE PORTION OF INTEREST IN THE STRATIGRAPHIC SECTION VERSUS THE TARGET RELATIVE DEPTH SCALE BY MULTIPLYING AN ACTUAL VALUE OF THE DATA POINT WITH AN ACTUAL SCALE FACTOR — 680

COMPUTER INSTRUCTIONS TO INSTRUCT THE PROCESSOR TO CALCULATE A "Y" AXIS VALUE FOR THE PLOT OF THE PORTION OF THE ACTUAL CURVE WITHIN THE PORTION OF INTEREST IN THE STRATIGRAPHIC SECTION VERSUS THE TARGET RELATIVE DEPTH SCALE BY DETERMINING A DIFFERENCE BETWEEN THE STARTING TARGET RELATIVE DEPTH OF THE STRATIGRAPHIC SECTION AND THE CHANGE IN TARGET RELATIVE DEPTH, AND THEN SUBTRACT THE TRUE VERTICAL DEPTH SHIFT FROM THE DETERMINED DIFFERENCE — 682

FIGURE 4E

7

COMPUTER INSTRUCTIONS TO INSTRUCT THE PROCESSOR TO PLOT THE STRATIGRAPHIC CROSS SECTION — 684

COMPUTER INSTRUCTIONS TO INSTRUCT THE PROCESSOR TO CALCULATE THE STRATIGRAPHIC CROSS SECTION CONSISTING OF MULTIPLE CURVES REPRESENTING TOPS OF FORMATIONS THROUGH WHICH THE WELLBORE HAS TRAVERSED OR IS EXPECTED TO TRAVERSE — 686

COMPUTER INSTRUCTIONS TO INSTRUCT THE PROCESSOR TO PLOT CURVES FOR EACH FORMATION IN THE STRATIGRAPHIC CROSS SECTION USING: THE TRUE VERTICAL DEPTH OFFSETS, THE STARTING MEASURED DEPTH, THE ENDING MEASURED DEPTH, THE DIP, AND THICKNESSES FROM THE OFFSET/TYPE TOPS TABLE — 688

COMPUTER INSTRUCTIONS TO INSTRUCT THE PROCESSOR TO DETERMINE TWO POINTS ALONG THE PLOTTED CURVES FOR EACH FORMATION IN THE STRATIGRAPHIC CROSS SECTION, WHEREIN A FIRST POINT REPRESENTS A STARTING POINT FOR A PORTION OF THE PLOTTED CURVE, AND A SECOND POINT REPRESENTS AN ENDING POINT FOR THE PORTION OF THE PLOTTED CURVE, AND WHEREIN THE PORTION OF THE PLOTTED CURVE REPRESENTS A FORMATION WITHIN THE PORTION OF INTEREST IN THE STRATIGRAPHIC SECTION — 690

COMPUTER INSTRUCTIONS TO INSTRUCT THE PROCESSOR TO USE AN "X" AXIS VALUE OF THE FIRST POINT OF A PREVIOUS STRATIGRAPHIC SECTION AS THE STARTING MEASURED DEPTH FOR THE CURRENT STRATIGRAPHIC SECTION — 692

COMPUTER INSTRUCTIONS TO INSTRUCT THE PROCESSOR TO CALCULATE A "Y" AXIS VALUE OF THE FIRST POINT BY SUMMING A "Y" AXIS VALUE OF A SECOND POINT OF A PREVIOUS STRATIGRAPHIC SECTION AND THE TRUE VERTICAL DEPTH OFFSET A CURRENT STRATIGRAPHIC SECTION — 694

COMPUTER INSTRUCTIONS TO INSTRUCT THE PROCESSOR TO USE AN "X" AXIS VALUE OF THE SECOND POINT AS THE ENDING MEASURED DEPTH FOR THE CURRENT STRATIGRAPHIC SECTION — 696

COMPUTER INSTRUCTIONS TO INSTRUCT THE PROCESSOR TO CALCULATE A CHANGE IN MEASURED DEPTH AS THE ABSOLUTE VALUE OF THE DIFFERENCE IN THE ENDING MEASURED DEPTH AND THE STARTING MEASURED DEPTH OF THE CURRENT STRATIGRAPHIC SECTION — 698

COMPUTER INSTRUCTIONS TO INSTRUCT THE PROCESSOR TO CALCULATE A CHANGE IN TRUE VERTICAL DEPTH BY MULTIPLYING THE TANGENT OF THE NEGATION OF THE DIP ANGLE FOR THE STRATIGRAPHIC SECTION WITH THE CHANGE IN MEASURED DEPTH OF THE CURRENT STRATIGRAPHIC SECTION — 700

COMPUTER INSTRUCTIONS TO INSTRUCT THE PROCESSOR TO CALCULATE A "Y" AXIS VALUE OF THE SECOND POINT BY SUMMING A "Y" AXIS VALUE OF THE FIRST POINT AND THE CHANGE IN TRUE VERTICAL DEPTH OF THE CURRENT STRATIGRAPHIC SECTION — 702

22

168

| | | | | |
|---|---|---|---|---|
| WELL NAME: | PUMA #5 | | GEOLOGIST: | GEORGE JONES |
| COUNTY: | MIDLAND | | KB ELEVATION: | 1234 |
| Geologist: | GEORGE JONES | email: | Confirm at Rig | |
| Office: | 432-555-4321 | gjones@selmanlog.com | | |
| Cell: | 432-555-1234 | | Date: 08/29/10 | |

PAYZONES: UPPER TOMMY LOWER TOMMY 170

172 174 178

| FORMATION | TOP | BASE | HEIGHT |
|---|---|---|---|
| FRESHWATER | 254 | 255 | 1 |
| SALT WATER | 376 | 376 | 0 |
| SELMAN SAND | 1734 | 1764 | 30 |
| THOMAS SS | 2822 | 3369 | 547 |
| BRIAN SHALE | 3632 | 4089 | 457 |
| JUSTIN MARKER 1 | 4473 | 4536 | 63 |
| ELLIE SAND | 6234 | 6264 | 30 |
| JODI SHALE | 6377 | 6381 | 4 |
| UPPER TOMMY | 6418 | 6541 | 123 |
| NIKKI SAND | 6484 | 6494 | 10 |
| BASE NIKKI SAND | 6541 | 6591 | 50 |
| LOWER TOMMY | 6591 | 6732 | 141 |
| MATT SPRINGS | 6682 | 6732 | 50 |
| HARD BOTTOM | 6732 | 6824 | 92 |

COMMENTS: TD: 6632

Target Line 180

*6632 TVD @ 725' VS @ 90 DEG. (+30 -30)

L.P. SubSea -5100

SIGNATURE: GEORGE JONES

FIGURE 5

Editing Table [ACTUAL] - 18

Table Name: 204

Calculation Method: Minimum Curvature 210

Proposed Azimuth: 149.0 deg 206

Target Angle: 90.0 deg 208

Target TVD: 6632.2 ft 212

Initial Values

TVD: 5824.90 214

VS: 115.70 216

Northing: -162.50 59

Easting: -54.50 220

202 196 198 200

| Tool | MD | Inclination | Azimuth | TVD | SSTVD | VS | N | E | CL | CD | CA | DLS | Build | Walk | BRN | RF |
|---|---|---|---|---|---|---|---|---|---|---|---|---|---|---|---|---|
| Tie In | 5830 | 2.2 | 196.78 | 5824.9 | -4590.90 | 115.70 | -162.50 | -54.50 | 0 | 0.00 | 0.00 | 0.00 | 0.00 | 0.00 | 0.00 | 1.00000000 |
| GYRO | 5859 | 1.5 | 206.1 | 5853.88 | -4619.88 | 111.80 | -163.37 | -54.83 | 29 | 172.33 | 198.55 | 2.62 | -2.41 | 32.14 | 7.17 | 1.00001465 |
| GYRO | 5890 | 2.3 | 172.8 | 5884.87 | -4650.87 | 112.59 | -164.36 | -54.93 | 31 | 173.29 | 198.48 | 4.29 | 2.58 | -107.42 | 7.36 | 1.00004500 |
| GYRO | 5921 | 4.2 | 158.3 | 5915.82 | -4681.82 | 114.28 | -166.03 | -54.43 | 31 | 174.72 | 198.15 | 6.63 | 6.13 | -46.77 | 7.41 | 1.00010726 |
| GYRO | 5951 | 6.2 | 153 | 5945.69 | -4711.69 | 116.98 | -168.49 | -53.29 | 30 | 176.72 | 197.55 | 6.85 | 6.67 | -17.67 | 7.45 | 1.00010719 |
| GYRO | 5981 | 9 | 149.6 | 5975.43 | -4741.43 | 120.94 | -171.96 | -51.37 | 30 | 179.47 | 196.63 | 9.45 | 9.33 | -11.33 | 7.36 | 1.00020402 |
| GYRO | 6012 | 11.7 | 150.9 | 6005.92 | -4771.92 | 126.51 | -176.80 | -48.61 | 31 | 183.36 | 195.37 | 8.74 | 8.71 | 4.19 | 7.29 | 1.00018646 |
| GYRO | 6042 | 14 | 151.7 | 6035.17 | -4801.17 | 133.18 | -182.65 | -45.41 | 30 | 188.21 | 193.96 | 7.69 | 7.67 | 2.67 | 7.28 | 1.00013510 |
| GYRO | 6073 | 16.7 | 151.8 | 6065.06 | -4831.06 | 141.37 | -189.88 | -41.53 | 31 | 194.37 | 192.34 | 8.71 | 8.71 | 0.32 | 7.20 | 1.00018511 |

Save and Close Save Close

FIGURE 7

METHOD FOR GEOSTEERING DIRECTIONAL DRILLING APPARATUS

FIELD

The present embodiments generally relate to a method for geosteering directional drilling equipment.

BACKGROUND

A need exists for a method for geosteering directional drilling equipment, such as horizontal drilling equipment, that can provide real-time formation information.

A further need exists for real-time location identification for a drilling bit during horizontal drilling.

The present embodiments meet these needs.

BRIEF DESCRIPTION OF THE DRAWINGS

The detailed description will be better understood in conjunction with the accompanying drawings as follows:

FIGS. 4A-4G depict a data storage usable with the method.

FIG. 5 is a presentation of a geological prognosis usable in the invention.

FIG. 7 is a representation of an actual survey usable in the method.

Figure 1:
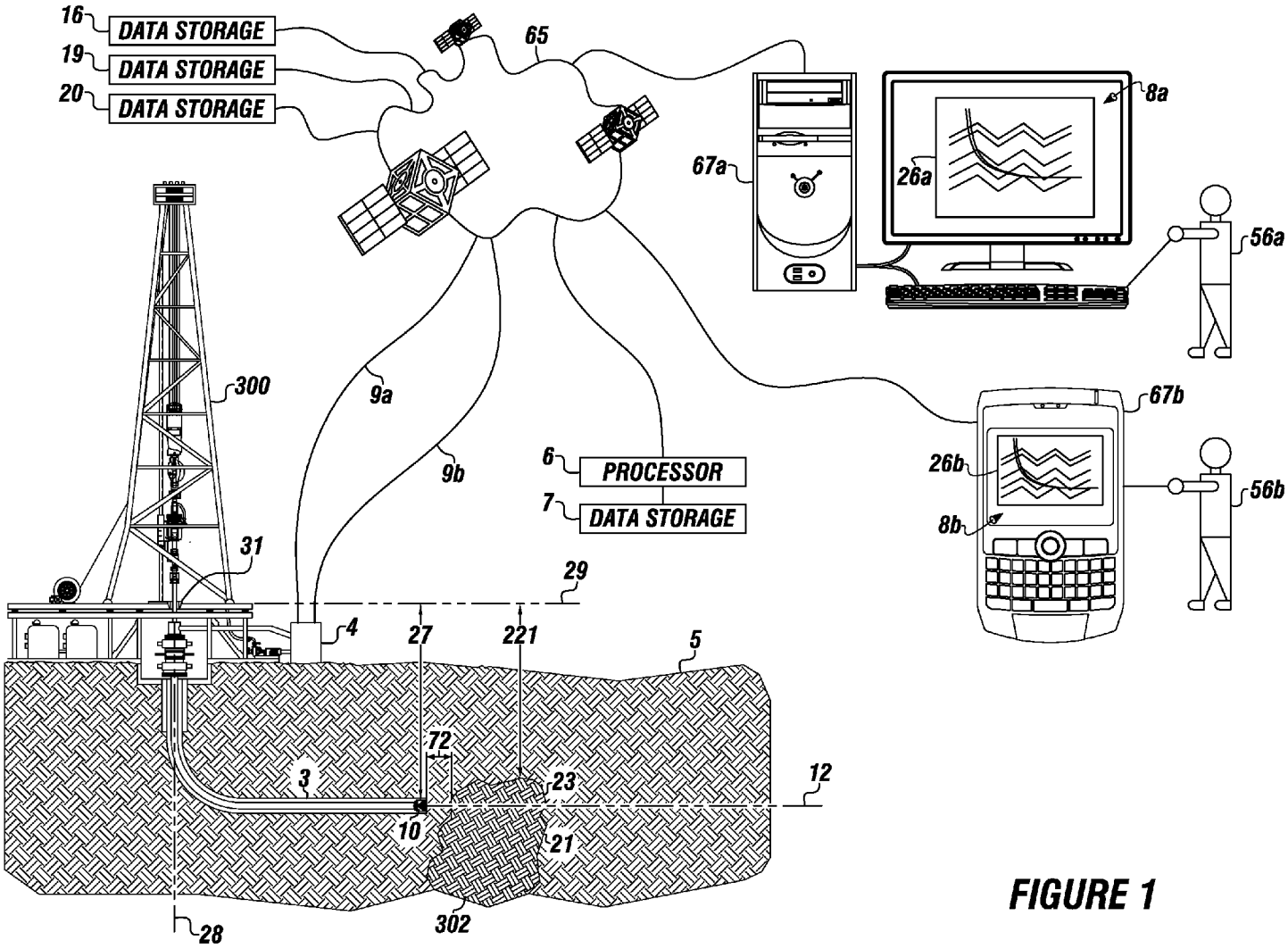
FIG. 1 is a schematic representation of a processing system usable with the method.

The present embodiments are detailed below with reference to the listed Figures.

DETAILED DESCRIPTION OF THE EMBODIMENTS

Before explaining the present method and associated system in detail, it is to be understood that the method and associated system are not limited to the particular embodiments and that the method and associated system can be practiced or carried out in various ways.

One or more of the present embodiments relate to a method that can include using a software program that can be used to directionally drill relief wells, such as when a blowout occurs.

One or more embodiments of the software program can be used for horizontal and directional drilling, and can utilize various geologic and seismic curves including gamma curves. The drilling discussed herein can include drilling for an oil well, a natural gas well, a water well, or any another type of subsurface well drilling.

The method can include using computer software designed to import and export WITS-compliant information. WITS, as used herein, stands for Wellsite Information Transfer Specification.

The computer software can enable a user of the method to receive and send updated drilling and seismic survey data from a plurality of formats, such as: WITSML, WITS, Log ASCII Standard (LAS), different streaming formats, different logging formats, and other formats installed for use. The receiving and sending of updated drilling and seismic survey data from the plurality of formats can occur in real-time, such as in a matter of seconds.

One or more embodiments of the method can be used: solely in the field adjacent a drilling site; remote from the drilling site, such as at an office; at sea on a subsea well site; or simultaneously from various remote and field locations. The method can include using an executive dashboard program that can be used to present data to a plurality of users simultaneously and in real-time. The executive dashboard can allow users to simultaneously view numerous pieces of data and information associated with the drilling.

The method can enable users, which can be computers, to more efficiently and effectively determine stratigraphy, dipping, and faulting by using graphical matching of actual curve data against reference curves, such as type log curves, using real-time drilling data.

The method can help users visualize formation structures by allowing users to explore formation structures in three dimensions and in two dimensions, and to explore different segments of a stratigraphic section or map simultaneously, thereby allowing the users to determine where a drilling bit is within a wellbore. The method can therefore be used to avoid disasters associated with formation problems, such as unexpected faults and the like.

One or more embodiments of the system for geosteering, also referred to as geo-steering of directional drilling equipment, can include a processor in communication with directional drilling equipment and with a data storage. The communication can occur through a network. The processor and the data storage can be used to receive and send data to the directional drilling equipment, and to control at least portions of the directional drilling equipment. The directional drilling equipment can include mud pumps, mud tanks, drilling pipe, controls, directional tools installed on a drill string, and similar conventional directional drilling equipment. The data received from the directional drilling equipment can be: an inclination of the wellbore as measured by a directional drilling tool, such as a sensor or gyro; a measured depth of the wellbore, such as a measured depth measured by a depth encoder on a crown of the drilling rig; a tool depth, which can be the measured depth minus the distance of the tool from the bottom of the drill string; an azimuth as measured by a sensor on a directional drilling tool; and actual curve data such as gamma ray readings and resistivity readings as measured by sensors on directional drilling tools. The processor can send data and/or commands the directional drilling equipment or to user's operating the directional drilling equipment, such as user's viewing the executive dashboard at the drilling site. The data and/or commands can include all of the data that can be presented in the executive dashboard as described herein and a suggested build rate to remain at a target depth or in a target formation, as well as other instructions regarding drilling. The commands can be: commands that directly control the directional drilling equipment, suggestions and/or instructions to user's on how to control the directional drilling equipment, or combinations thereof.

One or more embodiments can include client devices in communication with the processor through the network. The client devices can be computers; mobile devices, such as cellular phones; laptop computers; or another type of client device having communication means, processing means, and data storing means. Each client device can have a processor, a data storage, and a display. The network can be a wireless network, a wired network, or any other type of communications network.

In one or more embodiments, the processor with the data storage can be disposed at a drilling site, remote from the drilling site, or combinations thereof. The method can be used to form a new wellbore at the drilling site, such as in land that has not been previously drilled. Also, the method can be used to expand an existing wellbore. For example, the processor can be in communication with the directional drilling equipment, such as horizontal drilling equipment, for monitoring and controlling the drilling equipment.

The data storage can include a plurality of computer instructions. The data storage can include computer instructions to instruct the processor to create and present an executive dashboard. The executive dashboard can be presented to a user on a display of the user's client device. The executive dashboard can include a presentation of: a section of a formation, a location of a drill bit on a real-time basis, and other data associated with the drilling.

The executive dashboard can present numerous continuously updated data and pieces of information to a single user or simultaneously to a plurality of users connected together over the network. The executive dashboard can provide the users with the ability to continually monitor the drilling in real-time during the occurrence of the drilling in order to avoid dangers and environmental problems, such as disasters that occur in the Gulf of Mexico.

The method can be useful to enable users, such as responders, to quickly view the drilling to determine whether or not an actual drilling path of the drill bit is in compliance with a projected drilling path of the drill bit. For example, a projected drilling path can be determined and/or formed in order to prevent excursion into areas that would cause: damage to a water supply; an explosion; significant harm to humans, structures, or animals at the surface of the wellbore; or significant harm to marine life in a body of water. With the executive dashboard disclosed herein, the user can view the actual drill path and compare that to the projected drill path in real-time in order to avoid dangers. Real-time presentation of data onto the executive dashboard can refer to data that is presented on the executive dashboard in no more than ten seconds after the actual occurrence of an event associated with the data. For example, if the real-time presentation of data includes a location of the drill bit, the actual location of the drill bit can be measured and transmitted to the executive dashboard within ten seconds.

The executive dashboard can enable a user to view portions of interest in a stratigraphic cross section of the wellbore. The portions of interest in the stratigraphic cross section of the wellbore can be used to correctly identify a location of a drill bit within the wellbore. The identification of the location of the drill bit within the stratigraphic cross section, and therefore within the actual wellbore, allows a user to initiate action to fix any deviations of the actual drilling path from the projected drilling path.

The data storage can include computer instructions to instruct the processor to present an overlay of the actual drilling path over the projected drilling path. The data storage can include computer instructions to provide an alarm to the user, such as to the user's display, when a deviation of the actual drilling path from the projected path occurs.

The data storage can include computer instructions to instruct the processor to identify the projected path of a drilling bit used in directional drilling. For example, the processor can use a current inclination of the drill bit and a current true vertical depth of the drill bit to determine the projected path. The projected path can be a line from the current actual location of the drill bit and extending to a projected location of the drill bit that is estimated to occur in the future given the current inclination of the drill bit and the current true vertical depth of the drill bit.

The data storage can include computer instructions to instruct the processor to enable a selected projected path to be simultaneously viewed in two dimensions and in three dimensions within the executive dashboard.

The data storage can include computer instructions to present all data, information, multidimensional data, and images from the directional drilling equipment to a user on the user's client device as an executive dashboard. The data storage can include computer instructions to store all data, information, multidimensional data, and images from the directional drilling equipment in the data storage.

The data storage can include computer instructions to instruct the processor to communicate over the network to import data including a plurality of offset/type tops of formations. The imported plurality of offset/type tops of formations can include offset/type tops of formations that are projected to be traversed by the drill bit along the projected path. The data storage can include computer instructions to instruct the processor to save the imported plurality of offset/type tops of formations in an offset/type table in the data storage. The offset/type table can be presented within the executive dashboard. An offset/type top of a formation, as the term is herein used, can be a depth of a type log curve that has been selected and that corresponds to certain feature, such as tops of formations, markers, and other features. The type log curve can be a curve that includes multiple data points, such as those from a gamma ray analysis or another commonly known analytical method. Each data point can include a magnitude and a depth.

The data storage can include computer instructions to instruct the processor to import data including an actual survey of the wellbore. The actual survey data can include: a plurality of azimuths for the wellbore, a plurality of inclinations for the wellbore, a plurality of measured depth points for the wellbore path, and other data and information associated with an actual survey of the wellbore. The actual survey data can be stored in the data storage using computer instructions, and can be presented within the executive dashboard.

The data storage can include computer instructions to instruct the processor to import data including a geological prognosis on the wellbore site to a prognosed tops table, which can then be stored in the data storage. The geological prognosis can include: at least one depth for at least one formation top, a formation top through which the drill bit is expected to pass along the projected path, and other information. The prognosed tops table can be presented in the executive dashboard.

The data storage can include computer instructions to instruct the processor to construct a wellbore profile, to save the wellbore profile in the data storage, and to present the wellbore profile in the executive dashboard. The wellbore profile can include a composite visualization of a plurality of true vertical depths (TVD) of the wellbore, as can be more easily understood with reference to the figures below.

The data storage can include computer instructions to instruct the processor to use the imported data to form a stratigraphic cross section in the wellbore profile. The data storage can include computer instructions to instruct the processor to position the actual location of the drill bit onto the stratigraphic cross section. The stratigraphic cross section can include a depiction of a formation dipping away from an angle perpendicular to a horizontal plane representing the surface surrounding the wellbore. The stratigraphic cross section can include a depiction of a formation dipping toward the angle perpendicular to the horizontal plane representing the surface surrounding the wellbore.

The data storage can include computer instructions to instruct the processor to compute and plot the actual drilling path using the actual survey data. The data storage can include computer instructions to overlay the actual drilling path onto the stratigraphic cross section. The stratigraphic cross section can continuously be viewable in the executive dashboard in both three dimensions and two dimensions, such as during overlaying. The actual drilling path can be overlaid and plotted onto the projected path for the drilling bit in the stratigraphic cross section of the wellbore profile. With the actual drilling path overlaid and plotted onto the projected path for the drilling bit, the users can monitor the actual drilling path in real-time on the executive dashboard. The actual drilling path in view of the projected path of the drilling bit can be updated continually and/or continuously for real-time presentation on the executive dashboard.

The data storage can include computer instructions configured to instruct the processor to present a plurality of control buttons on a display within the executive dashboard. The control buttons can be viewed and operated by users. For example, the user can increase or decrease a starting measured depth of the drilling to predict drilling paths using one or more of the control buttons. The user can modify an ending measured depth of the drilling using one or more of the control buttons. The user can use the control buttons to modify values by increasing or decreasing the true vertical depth offset. The user can use the control buttons to increase or decrease dip or dip angle of formations, and to change which section of the wellbore is a portion of interest in the stratigraphic cross section.

In one or more embodiments, the data storage can include computer instructions configured to allow a user to increase or decrease values associated with each control button to modify: the start measured depth, ending measured depth, true vertical depth offset, dip or dip angle, or combinations thereof of portions of interest in the stratigraphic cross section to correctly identify the location of the drill bit in the stratigraphic cross section.

One or more embodiments can include computer instructions to instruct the processor to measure a distance, such as in feet or meters, at a angle perpendicular to a horizontal plane representing the surface surrounding the wellbore or the true vertical depth of the wellbore. The measurements can be initiated from a rotary table bushing, also known as a kelly bushing, to determine a current or final depth of the wellbore as plotted against the measured depth of a borehole. The measured depth of the wellbore can be equivalent to a length of the drill string when the drill bit is at a bottom or end of the borehole.

The data storage can include computer instructions to instruct the processor to present additional control buttons that control the rates of adjustment or granularity of the other controls.

The data storage can include computer instructions to instruct the processor to provide an alarm. The alarm can be provided when it appears or is determined that continued drilling within a formation will violate a permit, cause a safety hazard, cause an environmental hazard, cause an economic hazard, cause another hazard, or combinations thereof.

The data storage can include computer instructions to instruct the processor to superimpose the projected path for the drilling bit over a formation structure map, and to position the formation structure map behind the projected path to establish faults in the formation relative to the projected path and/or the actual drilling path. The formation structure map can be imported and/or inputted into the data storage from an external source and saved therein, and can include a calculated stratigraphic cross section before the wellbore has been drilled.

The data storage can include computer instructions to instruct the processor to superimpose the projected path for the drilling bit over stratigraphic cross section, and to position the stratigraphic cross section behind the projected path to establish formations simultaneously both in two dimensions and in three dimensions.

The data storage can include computer instructions to instruct the processor to form at least one report. Each report can include: any information imported and/or inputted into the data storage; any information and/or data stored in the data storage; any data received from the directional drilling equipment; any information and/or data presented within the executive dashboard; any information and/or date included within the various reports described herein; any information and/or data associated with the wellbore, the drilling equipment, and the drilling process; or combinations thereof. Similarly, the executive dashboard can present: any information imported and/or inputted into the data storage; any information and/or data stored in the data storage; any data received from the directional drilling equipment; any information and/or date included within the various reports described herein; any information and/or data associated with the wellbore, the drilling equipment, and the drilling process; or combinations thereof.

The data storage can include computer instructions to instruct the processor to plot an actual drilling path on a real-time basis in view of the projected path, and to transmit the plot along with images and a text report to a plurality of users simultaneously over the network for presentation on the executive dashboard.

The executive dashboard can include a report for a wellbore of current information. The current information can include: a current measured depth, such as 10500 feet, which can be adjustable using an onscreen control button. The current information can also include a current formation name, such as "Selman Formation". The formation name can be procured from an offset/type log table that the processor can obtain from communicating with another data storage accessible through the network.

The current information can include a "next formation name", such as "Juanita Shale", which can be obtained from the same or a similar data storage. The next formation name can be the name of the next formation through which the drill bit is expected pass through along the projected path. The current information can include location information for the current formation and for the next formation.

The data storage can include computer instructions to instruct the processor to compute a "distance to next formation" from the current formation, and to present the computed distance to next formation to the user within the executive dashboard.

The data storage can include computer instructions to instruct the processor to compute an "estimated subsea depth of next formation", such as −7842 feet, using the kelly bushing elevation and the estimated true vertical depth of the next formation. The estimated subsea depth of next formation can be presented to the user on the executive dashboard.

The data storage can include computer instructions to instruct the processor to compute the "current dip or dip angle". The current dip or dip angle, as the term is used herein, can be the angle of a formation referenced from the horizontal plane representing the surface surrounding the wellbore. In operation, if the angle is positive and the angle points towards the surface or is shallower, the current dip or dip angle can be referred to as "dipping towards" the wellbore; whereas if the angle is negative and the angle points away from the surface or is deeper, the current dip or dip angle can be referred to as "dipping away" from the wellbore.

The data storage can include computer instructions to instruct the processor to present a "current true vertical depth" in the executive dashboard, which can represent the distance measured at the angle perpendicular to the horizontal plane representing the surface surrounding the wellbore to the drill bit using the kelly bushing as a reference point on top of the wellbore.

The data storage can include computer instructions to instruct the processor to present a "current subsea true vertical depth" in the executive dashboard. The current subsea true vertical depth can be a true vertical depth that is referenced from sea level, wherein positive numbers can indicate depths that are above sea level and negative numbers can indicate depths that are below sea level.

The data storage can include computer instructions to instruct the processor to present a report to the users in addition to, and simultaneously with the executive dashboard.

The report can include past drilling data and estimated future drilling data. The report can include: at least one, and up to several thousand formation names, projected tops of each listed formation, and a true vertical depth as drilled for each formation. The report can include a value representing a difference between a projected top of a formation and a formation top as drilled. The report can include a dip or dip angle, measured in degrees, of a plurality of formations as drilled at the tops of the formations. The report can include each drill angle, measured in degrees. The drill angle can be the angle of inclination of the wellbore at the top of the formation as drilled. For example, the drill angle can be 25.3 degrees. The report can include an estimated distance needed for the drill bit to travel to reach a top of the next formation or to reach a selected formation considering the current drill angle and the current dip or dip angle of the formation. The report can include an estimated/actual subsea depth of formation relative to sea level of an encountered formation, of the next formation, or of a selected formation, considering the current drill angle and the current dip or dip angle of the formation.

The report can include identification information. The identification information can include: a job number; a well number; a location in which the well is being drilled, such as a country name, a state name, a county name; a rotary table bushing elevation, such as a kelly bushing elevation; a field name, such as the name of the field where the well is being drilled; a start date for drilling; a start depth for drilling, such as 1240 feet; an API number, wherein the term "API" refers to American Petroleum Institute; a UWI, wherein the term "UWI" refers to a Unique Well Identifier; a ground level elevation, such as 783 feet; a unit number, such as unit 2 of the Lyon field with 12 units; an end date of drilling; an end depth of the drilling, such as 10,700 feet; and other information. The API number can be a unique, permanent, numeric identifier assigned to each well drilled for oil and gas in the United States.

The data storage can include computer instructions to instruct the processor to display an actual location of a drilling bit on the actual drilling path within the executive dashboard for real-time identification of the drilling bit during horizontal drilling.

In one more embodiments, the stratigraphic cross section and/or the portion of interest in the stratigraphic cross section can be calculated using: the offset/type tops section through which the projected path will follow, which can be shown as a thicknesses between lines; the starting measured depths for the stratigraphic section of the wellbore; the ending measured depths for the stratigraphic section of the wellbore; the true vertical depth offset for the stratigraphic section of the wellbore; and the dip or dip angle for the stratigraphic cross section, which can be shown as an angle of tilt in the formation.

In one or more embodiments, the wellbore profile can be displayed with actual curves, which can be gamma ray curves. The wellbore profile can be displayed with curves that are total gas curves. Total gas can be the volume of gas detected at a particular measured depth. The actual curve can be a curve that includes multiple data points, such as those from a gamma ray analysis or another commonly known analytical method. Each data point can include a magnitude and a depth.

The stratigraphic cross section can be presented on the executive dashboard as a colored and/or visual map prior to importing the actual survey. Within the executive dashboard, different colors can represent different estimated tops of formations and other related data.

In one or more embodiments, the wellbore profile can include and provide a plot of the subsea true vertical depth against the true vertical depth and the measured depth of the wellbore.

A unique benefit of one or more embodiments is that projected formations can be presented as a geological hypothesis of the actual geological formation, thereby enabling users to perform adjustments to the drilling equipment in real-time using the data and controls provided by the executive dashboard. The user can adjust different values relative to the geological hypothesis using the control buttons, thereby enabling the geological hypothesis to continue to update as the drilling continues in real-time.

The geological prognosis, as the term is used herein, can include a stratigraphic section or map. The stratigraphic section or map can include: at least one identified depth of a formation top, at least one identified depth of a formation bottom, at least one anticline, at least one syncline, at least one depth of a fault, at least one bedding plane between two formations, a fracture line of at least one fault, or combinations thereof.

The geological prognosis can be generated using computer instructions stored in the data storage that instruct the processor to use a surface elevation or a rotary table bushing elevation of a surface for a start of a wellbore, and at least one offset/type top of the projected formation provided by a user.

In one or more embodiments, the actual curves and projected curves can be used as gamma curves from a type log.

The overlaying of the projected path onto the stratigraphic cross section can be performed by overlaying the projected path onto a three dimensional stratigraphic cross section, with the three dimensions being: easting, northing, and true vertical depth as overlaid on the azimuth of the projected path.

In one or more embodiments, a type log can be used as a test well to calculate thicknesses of formations and thicknesses of rock between formations. For example, by calculating an absolute value of the difference between the top true vertical depth of a first formation, the Juanita Shale formation, and the top true vertical depth of a second formation, the Nikki Sand formation, which, in this example, is the next deepest formation underneath the first formation, the thickness of the Juanita shale formation can be obtained.

In one or more embodiments, the plurality of offset/type tops can include a type log. An illustrative type log for the formation Juanita Shale can be the top true vertical depth value of 1,020 feet, and an illustrative type log for the formation Nikki Sand can be the top true vertical depth value of 1,200 feet.

The projected path can be generated using computer instructions in the data storage that instruct the processor to calculate the projected path using a kick off point, such as a depth of 4,500 feet, a build rate, such as 8 degrees/100 feet, and a target depth, such as 6,632 feet. In one or more embodiments, a user can provide the projected path, such as by uploading the projected path into the data storage.

The data storage can include computer instructions to instruct the processor to provide correlation points for at least one actual curve, or for at least one point along an actual curve of a stratigraphic section. Each correlation point can be tied to a known type log curve for confirming accuracy of the actual curve. For example, a plurality of sampling data points along a plot of an actual curve can be compared with sampling data points along a plot of a related type log curve. Correlation between the actual curve and the type log curve can be confirmed when the sampling data points in the actual curve match the sampling data points in the type log curve. An actual curve that has more matching sampling data points with the type log curve has a greater degree of correlation.

One or more embodiments can include computer instructions in the data storage configured to allow a user to thicken or thin a curve of the stratigraphic cross section in order to fit or correlate with type log curves.

In one or more embodiments, the user can be a processor, a computer, or another like device in communication with the processor of the system.

In one or more embodiments, after the wellbore is drilled, a user can analyze the wellbore profile to determine portions of the wellbore that are appropriate for perforation, fracing, and/or production stimulation during completion stage operations. For example, the user can highlight portions of the wellbore within the wellbore profile, such as by using an input device in communication with the executive dashboard. The data storage can include computer instructions to instruct the processor to configure the executive dashboard to allow the user to highlight portions of the wellbore profile within the executive dashboard. The user can highlight portions to indicate the portions of the wellbore that are appropriate for perforation, fracing, and/or production stimulation. Therefore, users, such as engineers, at a location remote for the drilling site can analyze the wellbore profile and can highlight portions for further drilling exploration. Then, users, such as wellbore completion personnel, located at the drilling site can see those highlighted portions on a presentation of the same executive dashboard and can use the information to perform well completion operations. The engineers can therefore use the executive dashboard to communicate to drill site personnel which areas within the wellbore to perform further perforation, fracing, and/or production stimulation. The method therefore provides a unique graphical representation and communication means for indicating perforation, fracing, and/or production stimulation areas within a wellbore.

The user can also highlight portions of the wellbore within the wellbore profile to indicate portions of the wellbore that the user has determined are not appropriate for perforating, fracing, and/or production stimulation. For example, the user can highlight portions of the wellbore that are appropriate for perforating, fracing, and/or production stimulation in a first color, and can highlight portions of the wellbore that are not appropriate for perforating, fracing, and/or production stimulation in a second color. Users of the method can therefore more efficiently implement perforating, fracing, and/or production stimulation in a wellbore without having to perform fracing, and/or production stimulation in areas which are not appropriate for fracing, and/or production stimulation, such as areas wherein an environmental, economic, or safety hazard exists.

In one or more embodiments, a textual report regarding areas appropriate and not appropriate for fracing, and/or production stimulation can be produced. This textual report can be presented in the executive dashboard along with the highlighted portions in the wellbore profile, and can be used in combination with the highlighted portions of the wellbore profile for determinations and communications.

Turning now to the Figures, FIG. 1 is a schematic representation of a system for geosteering during directional drilling of a wellbore 3 that can be used to implement the method.

The system can include a processor 6 in communication with a data storage 7. The processor 6 can be in communication with a network 65. The network 65 can be in communication with one or more client devices, here shown including client device 67*a* and client device 67*b*. Client device 67*a* is shown associated with a first user 56*a*, while client device 67*b* is shown associated with a second user 56*b*. Each client device 67*a* and 67*b* has a display 8*a* and 8*b* respectively, for presenting the executive dashboard, shown as executive dashboard 26*a* and executive dashboard 26*b* respectively.

The processor 6 can be in communication with directional drilling equipment 4 for steering a drill bit 10 in the wellbore 3.

In operation, the processor 6 can receive data 9*a* from the directional drilling equipment 4 concerning a current status of the drilling. The processor 6 can store this received data 9*a* in the data storage 7 and can present this data 9*a* in various forms to the client devices 67*a* and 67*b* in the executive dashboards 26*a* and 26*b*. The processor 6 can send data and/or commands 9*b* to the directional drilling equipment 4.

The processor 6 can also receive additional data from other sources, including data that is input by users or data from additional data storages, such as a second data storage 16, a third data storage 19 or a fourth data storage 20.

The executive dashboards 26*a* and 26*b* can present this additional data along with the received data 9*a* to the users 56*a* and 56*b*. The processor 6 can use the received data 9*a* and additional data to perform calculations and to make determinations associated with the drilling process.

The executive dashboards 26*a* and 26*b* can allow the users 56*a* and 56*b* to analyze the received data 9*a* and the additional data, and to provide control commands using control buttons on the executive dashboards 26*a* and 26*b*.

In embodiments, control commands can be performed by one user on the executive dashboard that can be seen by all user's viewing the executive dashboard.

A depth 221 for a formation 302 with a formation dipping away from the angle 21 perpendicular and a formation dipping toward the perpendicular angle 23 is depicted. A projected path 12 of the drill bit 10 is depicted passing through the formation 302. Also, a distance to the next formation 72 is shown.

A surface 5 of the wellbore 3 is depicted with a kelly bushing 31 of a drilling rig 300. A perpendicular angle 28 can be computed from the kelly bushing 31.

A horizontal plane 29 representing the surface 5 where the wellbore 3 is drilled along with the perpendicular angle 28 from the horizontal plane 29 can be used to determine the true vertical depth 27 (TVD) of the wellbore 3.

Figure 2:
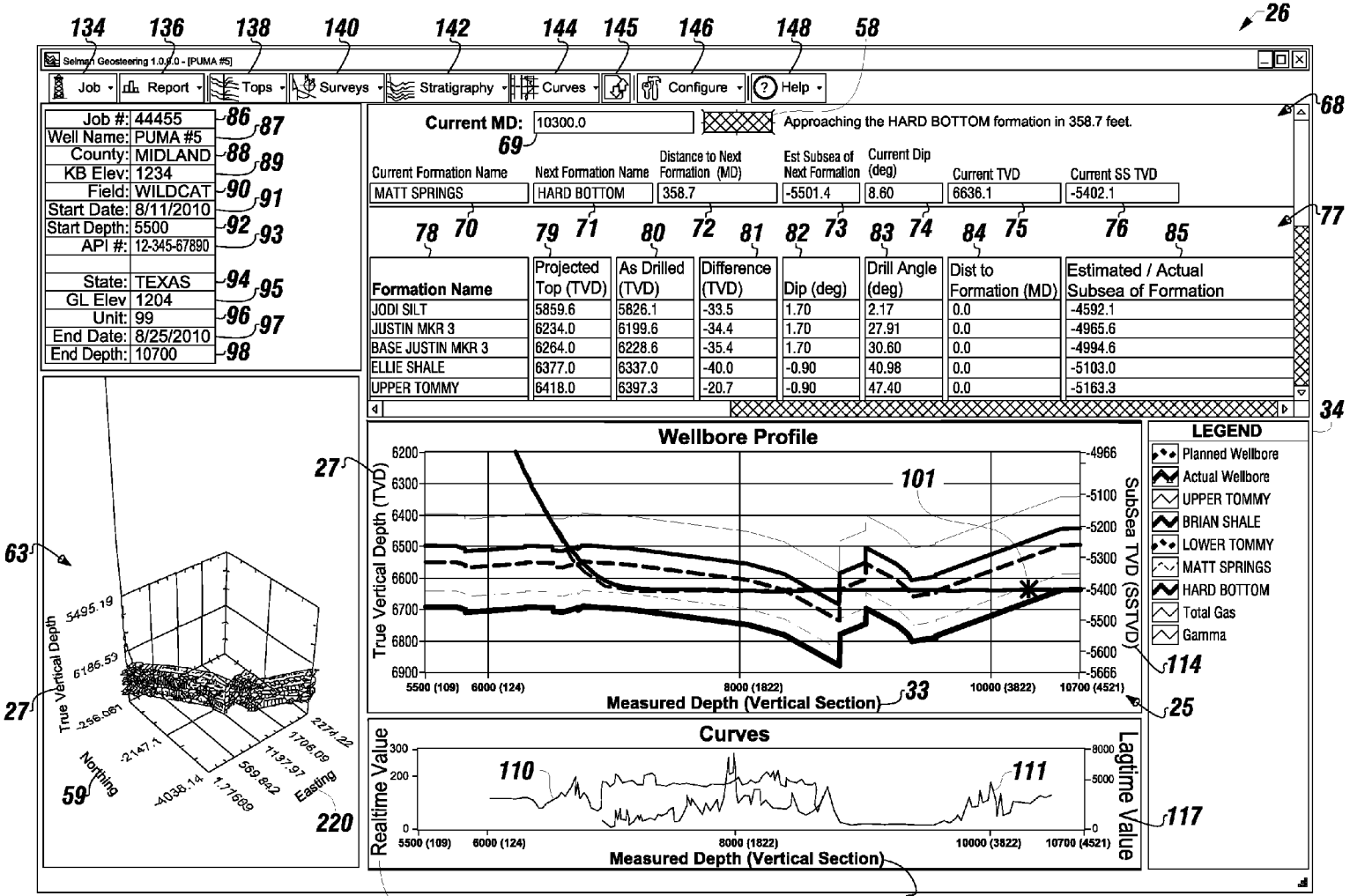
FIG. 2 is an executive dashboard for the method for geosteering during directional drilling.

FIG. 2 depicts an embodiment of the executive dashboard 26 of the system for geosteering during directional drilling that can be used to implement the method.

The executive dashboard 26 can be a composite visualization that presents a wellbore profile 25. The wellbore profile 25 can include true vertical depths 27 (TVD) and subsea true vertical depths 114 (SSTVD) plotted with respect to measured depths 33. The actual location of the drill bit 101 can be seen in the wellbore profile 25.

The true vertical depths 27 for the stratigraphic cross section are shown here ranging from 6,200 feet to 6,900 feet. The measured depths 33 of the vertical section are shown here ranging from 5,500 feet to 10,700 feet. The subsea true vertical depths are shown here ranging from −4,966 feet to −5,666 feet. Any variation of feet for a given formation can be used.

The executive dashboard 26 can include a toolbar located at a top of the executive dashboard. The tool bar can include a job management menu 134 that allows a user to choose at least one of the following options: new, open from local database, open from file, close, edit job information, save/export job to file, and exit program.

The toolbar can include a report generation menu 136 that allows the user to choose at least one of the following options: create a PDF report or create a rich text format report (RTF report).

The toolbar can include a tops button 138 that can produce a drop down menu allowing the user to edit a type log and edit a prognosed tops table.

The toolbar can include a survey button 140 that allows the user to choose at least one of the following: edit a planned survey or edit an actual survey. For example, a planned survey can include the kick off point for a proposed wellbore, a landing point for the proposed wellbore, and a target true vertical depth for the proposed wellbore.

The toolbar can include a stratigraphy button 142 that permits the user to edit stratigraphy adjustments to cause the fitting/correlation of the actual curve, such as a gamma ray curve 110 and total gas curve 111, to a reference curve, such as a type log gamma ray curve.

The toolbar can include a curve button 144 that enables the user to perform editing of continuous curves used in the wellbore profile 25, such as the gamma curve 110 and the total gas curves 111. For example, the user can add values versus measured depths in a table that produces the continuous curves of the wellbore profile.

The toolbar can include an update button 145 that allows the user to update data from data sources in a synchronized manner.

The toolbar can include a configure button 146 that allows the user to select at least one of the following: formations, curves, data sources, data source mappings, alarms, the number of days left on a license key, and information on the validity of a license key. For example, the user can select the formations and can configure a formation set of data by adding formations to the formation set, removing formation from the formation set, configuring line styles, line thicknesses, and line colors of formations, or combinations thereof.

The toolbar can include a help button 148 that allows the user to type questions and receive answers based on key words within the user's questions.

The executive dashboard 26 can include report information, including: a job number 86 shown as 44455; a well name or number 87, shown as PUMA #5; a county 88, shown as Midland; a kelly bushing elevation 89, shown as 1234; a field name 90, shown as WILDCAT; a start date for drilling 91, shown as Aug. 11, 2010; a start depth for drilling 92, shown as 5500 feet; an American Petroleum Institute (API) number 93, shown as 12-345-67890 which is a unique number for a well drilled in the United States; a state in which the drilling occurs 94, shown as Texas; a ground level elevation 95, shown as 1204; a unit number 96, shown as 99; an end date of drilling 97, shown as Aug. 25, 2010; and an end depth of the drilling 98, shown as 10700 feet.

The executive dashboard 26 can include current information 68, which can include: a current measured depth 69, shown as 10300.0 feet; a current formation name 70, such as MATT SPRINGS; a next formation name 71, such as HARD BOTTOM; a distance to next formation 72, show as 358.7 feet; an estimated subsea of next formation 73, shown as −5501.4 feet; a current dip 74, shown as 8.60 degrees; a current true vertical depth 75, shown as 6636.1 feet; and a current subsea true vertical depth 76, shown as −5402.1 feet.

The executive dashboard 26 can include a report 77, which can include: at least one formation name 78, such as UPPER TOMMY; at least one projected top 79 of the formation associated with the formation name, such as 6418.0; at least one true vertical depth as drilled 80, shown as 6397.3; at least one difference between a projected top and an as drilled top 81, shown as −20.7; at least one dip for a formation name as drilled at a top of the formation 82, shown as −0.90; at least one drill angle 83 of the wellbore at the top of the formation with a drilled top, shown as 47.40; at least one distance to formation 84, shown as 0.0; and at least one estimated/actual subsea of formation depth relative to sea level of the current formation 85, shown as −5163.3. The at least one distance to formation 84 can be a distance to the next formation or to a selected formation at a known drill angle and at a known dip of the current formation.

The executive dashboard 26 can include a legend 34 which can show the planned wellbore, the actual wellbore, formation names, current formation name, next formation name, total gas curves and gamma ray curves, other curves, as well as other information.

The executive dashboard 26 can display the gamma ray curve 110, which are also known as "gamma curves", and the total gas curve 111. The gamma ray curve 110 can be formed by plotting a real-time value 115, here shown with a range from 0 to 300, against the measured depths 33 of the wellbore, here shown ranging from 5500 feet to 10700 feet. The total gas curves 111 can be formed by plotting a lag time value 117, shown as ranging from 0 to 8000, against the measured depths 33 of the wellbore.

The executive dashboard 26 can present a three dimensional plot 63 of a projected path for a drill bit simultaneously as superimposed over the stratigraphic cross section.

The three dimensional plot 63 includes northing 59 as the "y" axis, easting 220 as the "x" axis, and true vertical depth 27 as the "z" axis.

Each portion of the executive dashboard 26 can be presented simultaneously to a plurality of users with client devices over a network, providing for constant monitoring and increased safety during drilling operations.

An alarm 58 is shown as a "red flag area" indicated on the executive dashboard 26. The alarm 58 can inform the user that the drill bit is about to enter dangerous territory and should be realigned. The alarm 58 can be formed from computer instructions that transmit an alarm when the data from the actual drill bit location exceeds or does not meet preprogrammed levels in the computer instructions resident in the data storage associated with the processor that controls this directional geosteering.

In one or more embodiments the executive dashboard can include an indicator or box on the first relative matching graph that shows the position of the first relative matching graph with respect to the second relative matching graph.

Figure 3:
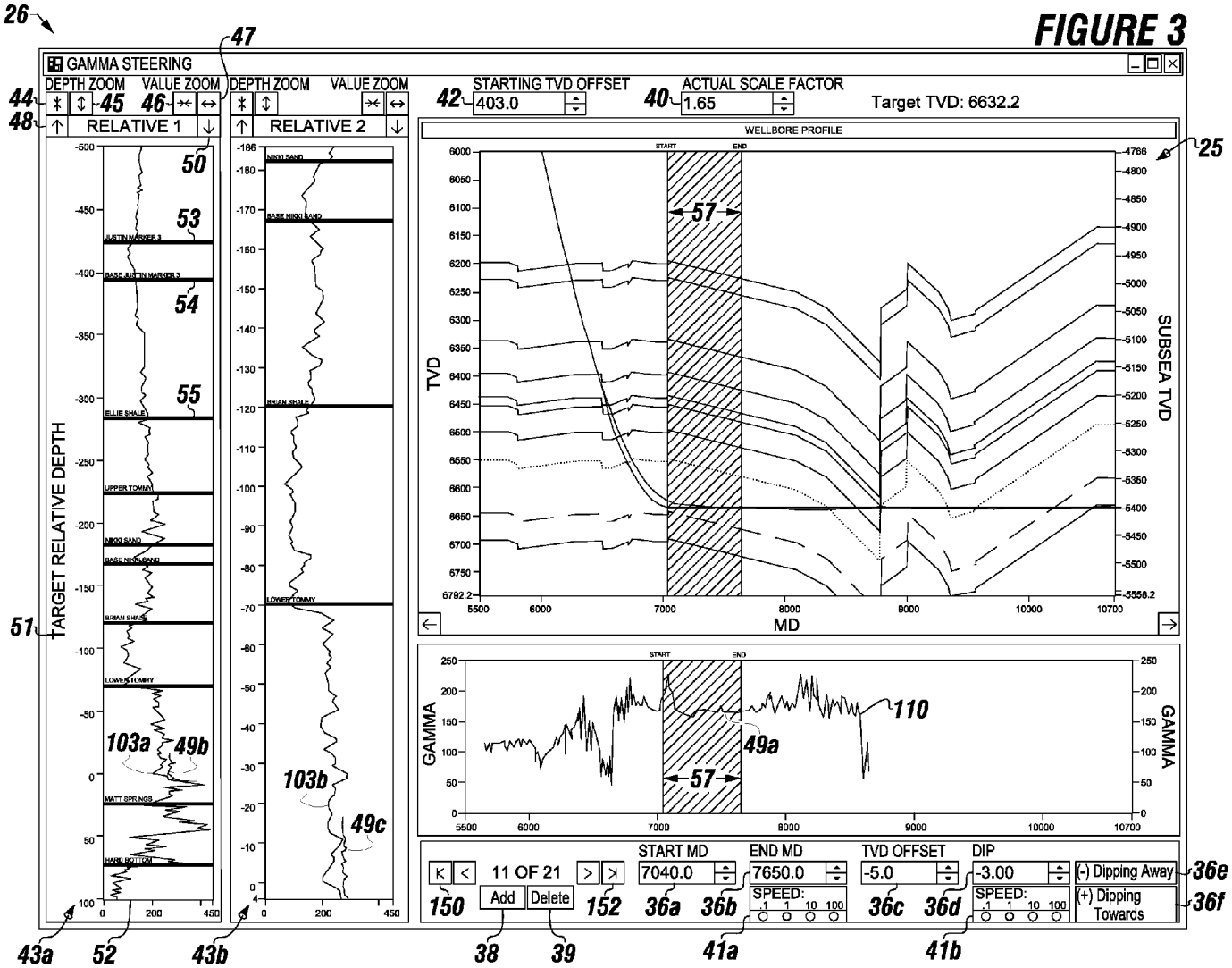
FIG. 3 is an executive dashboard of a stratigraphic cross section with two relative matching graphs.

FIG. 3 depicts an embodiment of an executive dashboard 26 with a plurality of control buttons that can be presented to a user to manipulate, such as by clicking a mouse over the buttons.

The control buttons can include: a control button 36*a* to manipulate a start measured depth, a control button 36*b* to manipulate an ending measured depth, a control button 36*c* to manipulate a true vertical depth offset, and a control button 36*d* to manipulate a dip or dip angle in degrees. For example, the user can increase values, decrease values, or replace a value with a new value using the control buttons.

A first indicator 36*e* to identify dipping away from the projected path of the drill bit, and a second indicator 36*f* to identify dipping towards the projected path of the drill bit are also depicted.

Additional navigation controls can be presented to the user, including a first navigation control 150 for moving the portion of interest in the stratigraphic section in a first direction along the stratigraphic cross section, and a second navigation control 152 for moving portion of interest in the stratigraphic section 57 in a second direction along the stratigraphic cross section. In one or more embodiments, the navigation controls can have "double" arrows for moving a user to the end or start of a stratigraphic cross section.

The executive dashboard 26 can have additional buttons that can be used to manipulate a first relative matching graph 43*a* and a second relative matching graph 43*b*.

The additional control buttons include an actual scale factor button 40 that can be used to increase or decrease a scale value of the actual curves for both of the relative matching graphs, such as the gamma ray curves and the total gas curves.

The executive dashboard 26 can include a control button 42 to set, change, increase, or decrease a starting true vertical depth offset of a type log curve for both of the relative matching graphs.

The additional controls for the relative matching graph 43*a* can include a control button 44 for each of the relative matching graphs that can be used for depth zoom-in and a control button 45 for each of the relative matching graphs that can be used for depth zoom-out. For example, a user can use a depth zoom-in to examine the curve values in more detail to achieve a better or desired curve fit.

A control button 46 for each of the relative matching graphs that can be used for value zoom-in, a control button 47 for each of the relative matching graphs that can be used for value zoom-out, and a control button 48 for each of the relative matching graphs that can be used to scroll up along the relative matching graph 43*a*. For example, a user can use a value zoom-out button to examine the curve from a macro perspective rather than in detail.

A control button 50 for each of the relative matching graphs is also used to scroll down along the relative matching graph 43*a*. For example, the user can use control button 50 to view different portions of the relative graph. The relative matching graph 43*b* can have the same additional control buttons, which are not labeled in this figure.

The relative matching graphs can be formed by plotting the target relative depth scale 51 versus the value scale 52. The target relative depth scale 51 can be a true vertical depth scale that is relative to the target true vertical depth. For example, if the target true vertical depth is 6632 feet, this target true vertical depth can be set as a zero on the target relative depth scale 51, such that a value of −100 feet on the target relative depth scale 51 would represent 6532 feet in terms of true vertical depth, and a value of 50 feet on the target relative depth scale 51 would represent 6682 feet in terms of true vertical depth. The value scale 52 can be a real-time value of the actual curves and type log curves, such as the gamma ray curves and other curves.

The relative matching graph 43*a* can include: the first formation/marker top 53, the second formation/marker top 54, and the third formation/marker top 55. In operation, a user can use the two relative matching graphs to view two separate views of the actual curve overlaid onto the type log curve, thereby simultaneously viewing a macro and a micro view of the curve fit.

The executive dashboard 26 can include additional control buttons, which can be disposed below the plot of the actual curves, such as the gamma rays curve 110, which are disposed below the wellbore profile 25. For example, the executive dashboard 26 can include a control button 38 to add a stratigraphic section to the wellbore profile, and control button 39 to delete a stratigraphic section to the wellbore profile. For example, the user can add a stratigraphic section representing the measured depths of the wellbore starting at 7040 feet and ending at 7650 feet to the wellbore profile 25. The executive dashboard 26 can include speed control 41*a* and speed control 41*b*, which can each be used to adjust a rate of change of the other controls of the executive dashboard 26.

The wellbore profile 25 and the plot of the actual curves, such as the gamma ray curve 110, can include a portion of interest in the stratigraphic section 57. A portion of the actual curve 49*a* within the portion of interest in the stratigraphic section 57 can be plotted within each of the relative matching graphs 43*a* and 43*b*, shown as 49*b* and 49*c* respectively, along with the type log curves 103*a* and 103*b* respectively.

In operation, the user can add stratigraphic sections using the control buttons. Then, for each stratigraphic section, the user can adjust a width of the portion of interest in the stratigraphic section 57. Then, for each stratigraphic section, the user can then adjust true vertical depth offset and the dip or dip angle using the control buttons such that the actual curve overlays the type log curve to achieve the highest degree of fit/correlation between the two curves as is possible. Adjusting the true vertical depth offset in the actual curve changes the vertical shift of the actual curve as plotted. Adjusting the dip or dip angle of the actual curve changes the thickness, shape, and direction of the actual curve as plotted.

Upon selection of the portion of interest in the stratigraphic section 57 within the wellbore profile 25, the portion of the actual curve 49*a*-49*c* within the portion of interest in the stratigraphic section 57 is presented within the relative matching graphs 43*a* and 43*b* along with the type log curves 103*a* and 103*b*. Upon adjustments to the true vertical depth offset and the dip or dip angle using the control buttons 36*c* and 36*d*, the adjustments can also be reflected in the relative matching graphs 43*a* and 43*b* and in the wellbore profile 25. The user can then use the actual curves 49*a*-49*c* and the type log curves 103*a* and 103*b* presented within the relative matching graphs 43*a* and 43*b* to match portions of the actual curve to portions of the type log curve in order to determine the best fit/correlation between the two curves. The user can repeat the above steps for all of the portions of interest in the stratigraphic section 57 for which the user has an actual curve 49*a*-49*c* to match with a type log curve 103*a* and 103*b*. As the wellbore is drilled, new data will be received by the processor from the directional drilling equipment, thereby providing new actual curves, and allowing portions of the new actual curves to be compared to the type log curves 103*a* and 103*b* for fitting/correlation.

FIGS. 4A-4G are a representation of the data storage of the system. The computer instructions disclosed herein can be used to perform various steps of the method.

Figure 4A:
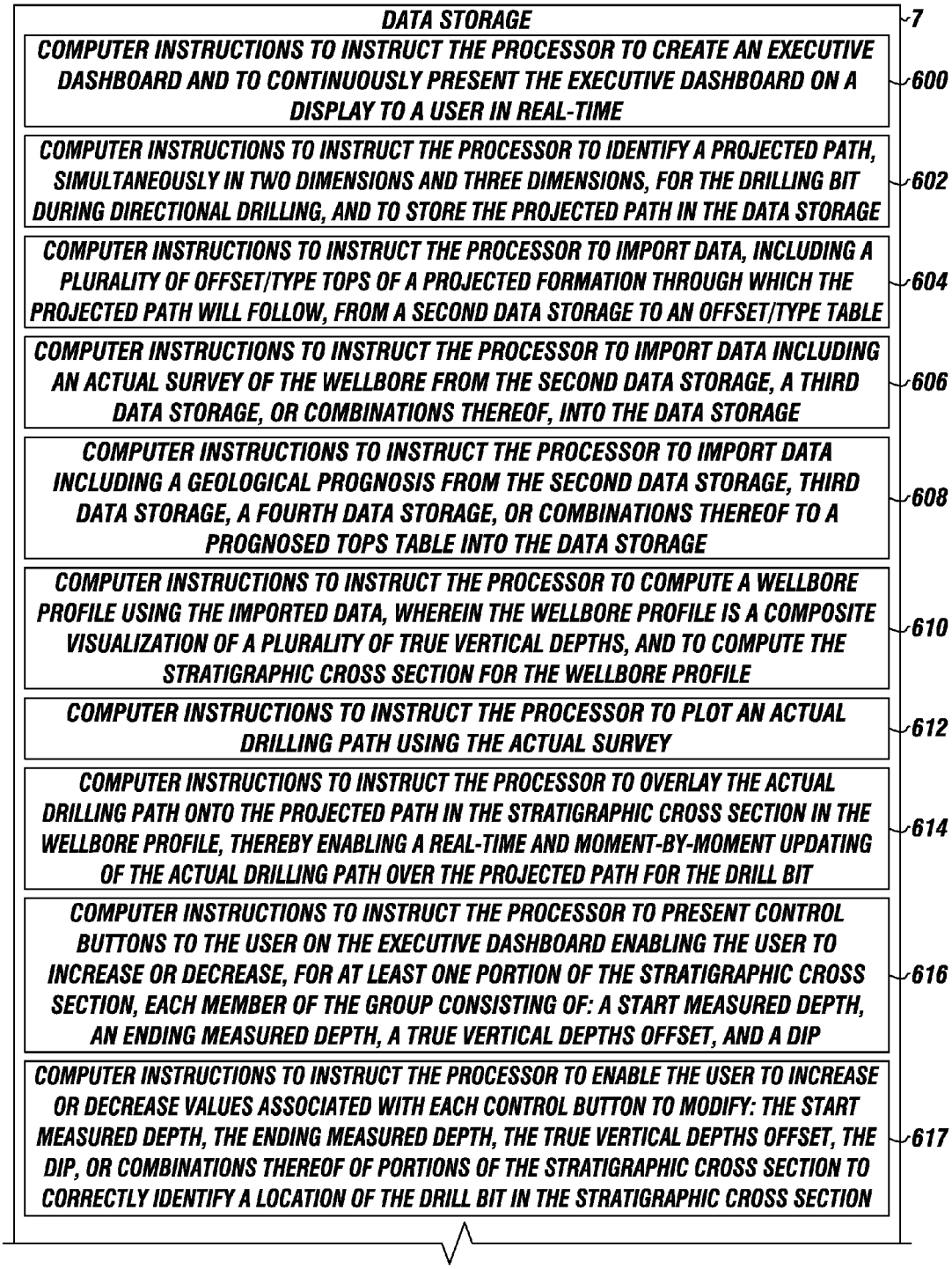

FIG. 4A shows that the data storage 7 can include computer instructions 600 to instruct the processor to create an executive dashboard and to continuously present the executive dashboard on a display to a user in real-time.

The data storage 7 can include computer instructions 602 to instruct the processor to identify a projected path, simultaneously in two dimensions and three dimensions, for the drilling bit during directional drilling, and to store the projected path in the data storage.

The data storage 7 can include computer instructions 604 to instruct the processor to import data, including a plurality of offset/type tops of a projected formation through which the projected path will follow, from a second data storage to an offset/type table.

The data storage 7 can include computer instructions 606 to instruct the processor to import data including an actual survey of the wellbore from the second data storage, a third data storage, or combinations thereof, into the data storage.

The data storage 7 can include computer instructions 608 to instruct the processor to import data including a geological prognosis from the second data storage, third data storage, a fourth data storage, or combinations thereof to a prognosed tops table into the data storage.

The data storage 7 can include computer instructions 610 to instruct the processor to compute a wellbore profile using the imported data, wherein the wellbore profile is a composite visualization of a plurality of true vertical depths, and to compute the stratigraphic cross section for the wellbore profile.

The data storage 7 can include computer instructions 612 to instruct the processor to plot an actual drilling path using the actual survey.

The data storage 7 can include computer instructions 614 to instruct the processor to overlay the actual drilling path onto the projected path in the stratigraphic cross section in the wellbore profile, thereby enabling a real-time and moment-by-moment updating of the actual drilling path over the projected path for the drill bit. A user can therefore view the actual drilling path and the projected drilling path in the executive dashboard.

The data storage 7 can include computer instructions 616 to instruct the processor to present control buttons to the user on the executive dashboard enabling the user to increase or decrease, for at least one portion of the stratigraphic cross section, each member of the group consisting of: a start measured depth, an ending measured depth, a true vertical depths offset, and a dip.

The data storage 7 can include computer instructions 617 to instruct the processor to enable the user to increase or decrease values associated with each control button to modify: the start measured depth, the ending measured depth, the true vertical depths offset, the dip, or combinations thereof of portions of the stratigraphic cross section to correctly identify a location of the drill bit in the stratigraphic cross section.

FIG. 4B is a continuation of FIG. 4A. The data storage 7 can include computer instructions 618 to instruct the processor to compute the true vertical depths as measured at the perpendicular angle from the horizontal plane representing the surface surrounding the wellbore using measured depths, inclinations, and azimuths; to plot the true vertical depths versus the measured depths of the drill bit; and to present the plotted true vertical depths versus the measured depths within the wellbore profile in the executive dashboard.

The data storage 7 can include computer instructions 620 to instruct the processor to present a first speed control button in the executive dashboard to control a rate of adjustment for control buttons, and a second speed control button to control a rate of adjustment for control buttons.

The data storage 7 can include computer instructions 622 to instruct the processor to transmit an alarm if continued drilling in a formation: will violate a permit, will pose a safety hazard, will be an economic hazard, or combinations thereof.

The data storage 7 can include computer instructions 624 to instruct the processor to superimpose the projected path for the drill bit over a formation structure map to determine faults through which the projected path will pass.

The data storage 7 can include computer instructions 626 to instruct the processor to superimpose the projected path for the drill bit over the stratigraphic cross section to determine formations through which the projected path will pass.

The data storage 7 can include computer instructions 628 to instruct the processor to form a report of the projected path and the actual drilling path, and to present the report of the projected path and the actual drilling path in the executive dashboard to be viewed in real-time by a plurality of users simultaneously.

The data storage 7 can include computer instructions 630 to instruct the processor to form a report of past drilling data and planned drilling actions associated with the executive dashboard.

The data storage 7 can include computer instructions 632 to instruct the processor to display in the executive dashboard an actual location of the drill bit on the actual drilling path for instantaneous identification of the drill bit during horizontal drilling.

The data storage 7 can include computer instructions 634 to instruct the processor to use a surface elevation or a rotary table bushing elevation of a surface for a start of a bore hole and at least one offset/type tops of the projected formation to generate the geological prognosis.

The data storage 7 can include computer instructions 636 to instruct the processor to use type log tops from a vertical well proximate the wellbore to calculate thicknesses of formations, thicknesses of rock between formations, other geological features, or combinations thereof. The vertical well proximate the wellbore can be used as a reference point to represent geological features of the area proximate the wellbore, such as thicknesses of formations and thicknesses of rock between formations.

FIG. 4C is a continuation of FIG. 4B. The data storage 7 can include computer instructions 638 to instruct the processor to generate the projected path by calculating the projected path using a kick off point, a build rate, a landing point, and a target angle. The kick off point can be the portion of the wellbore wherein the horizontal drilling begins. The build rate can be the rate of change of inclination of the wellbore to reach the landing point. The landing point can be the point at which the wellbore reaches a target depth. The target angle can be the angle of inclination of the wellbore as it extends from the landing point.

The data storage 7 can include computer instructions 640 to instruct the processor to provide correlation points for at least one actual curve or at least one point along an actual curve of the stratigraphic cross section, wherein each correlation point is tied to a known type log curve for confirming accuracy of the actual curve, accuracy of a fit of the actual curve to the known type log curve, or combinations thereof.

The data storage 7 can include computer instructions 642 to instruct the processor to provide correlation points for at least one actual curve or at least one point along an actual curve of the stratigraphic cross section to allow the user to thicken or thin each actual curve of the stratigraphic cross section to fit a known type log curve.

The data storage 7 can include computer instructions 644 to instruct the processor to present the projected path in the executive dashboard simultaneously in two dimensions and in three dimensions. The three dimensional presentation of the projected path includes an overlay of an ownership map for the land and a microseismic plot of the land along an azimuth of the wellbore. The ownership map can be used to determine whether or not the actual drilling path and the projected path are within land ownership/lease boundaries.

The data storage 7 can include computer instructions 646 to instruct the processor to store data received from the directional drilling equipment within the data storage.

The data storage 7 can include computer instructions 648 to instruct the processor to communicate over a network and to import the plurality of offset/type tops of the projected formation through which the projected path will follow.

The data storage 7 can include computer instructions 650 to instruct the processor to save the wellbore profile in the data storage.

The data storage 7 can include computer instructions 652 to instruct the processor to transmit the wellbore profile to the display.

The data storage 7 can include computer instructions 654 to instruct the processor to compute a "distance to next formation" using the measured depth from the current formation, and present the computed "distance to next formation" to the user within the executive dashboard.

The data storage 7 can include computer instructions 656 to instruct the processor to use an estimated true vertical depth of the next formation and a kelly bushing elevation to compute an "estimated subsea depth of next formation", and present the "estimated subsea depth of next formation" to the user in the executive dashboard.

The data storage 7 can include computer instructions 658 to instruct the processor to determine a "current dip". For example, the computer instructions 658 can be used to determine a current dip angle of a current formation.

The data storage 7 can include computer instructions 660 to instruct the processor to calculate a "current true vertical depth", and to present the "current true vertical depth" in the executive dashboard.

FIG. 4D is a continuation of FIG. 4C. The data storage 7 can include computer instructions 662 to instruct the processor to present the reports to the user in addition to and simultaneously with the executive dashboard.

The data storage 7 can include computer instructions 664 to instruct the processor to configure the executive dashboard to allow users to highlight portions of the wellbore profile.

The data storage 7 can include computer instructions 666 to instruct the processor to plot an actual curve and to plot a type log curve within the same graph for fitting/correlation of the actual curve to the type log curve.

The data storage 7 can include computer instructions 668 to instruct the processor to form a plot of a portion of the actual curve within the portion of interest in the stratigraphic section versus the target relative depth scale.

The calculation used to plot the portion of the actual curve within the portion of interest in the stratigraphic section versus the target relative depth scale can include as factors: the true vertical depths of the wellbore that passes through the stratigraphic section, as well as any formation dips and/or faults that occur in the stratigraphic section. For example, the plot of the portion of the actual curve within the portion of interest in the stratigraphic section versus the target relative depth scale can be calculated by taking each sampling data point along the portion of the actual curve having a measured depth and an actual value, and performing calculations on those sampling data points.

The calculations performed on the sampling data points can be performed using computer instructions. For example, the data storage 7 can include computer instructions 670 to instruct the processor to calculate a change in true vertical depth due to a dip or dip angle. The calculation of the change in true vertical depth due to the dip or dip angle can be performed by multiplying the tangent of the negation of the dip angle for the stratigraphic section with the absolute value of the difference in the measured depth and the starting measured depth of the stratigraphic section.

The data storage 7 can include computer instructions 672 to instruct the processor to calculate the true vertical depth at the starting measured depth for the stratigraphic section using the actual survey stored in the data storage. The calculation of the true vertical depth at the starting measured depth for the stratigraphic section using the actual survey stored in the data storage can also be performed using the computer instructions 660, but using a measured depth other than the current measured depth.

The data storage 7 can include computer instructions 674 to instruct the processor to calculate the true vertical depth at the measured depth of the data point along the actual curve using the actual survey within the data storage. The calculation of the true vertical depth at the measured depth at the data point along the actual curve using the actual survey within the data storage can be performed using the computer instructions 660.

The data storage 7 can include computer instructions 676 to instruct the processor to calculate a change in the true vertical depth due to a change in true vertical depth in the actual survey by determining a difference between the true vertical depth at the starting measured depth and the true vertical depth at the measured depth at the data point along the actual curve.

The data storage 7 can include computer instructions 678 to instruct the processor to calculate a change in target relative depth by performing a summation of the change in true vertical depth due to dip and the change in true vertical depth due to the change in true vertical depth in the actual survey.

The data storage 7 can include computer instructions 680 to instruct the processor to calculate an "X" axis value for the plot of the portion of the actual curve within the portion of interest in the stratigraphic section versus the target relative depth scale by multiplying an actual value of the data point with an actual scale factor.

The actual scale factor can be set by a user using the control buttons in the executive dashboard.

The data storage 7 can include computer instructions 682 to instruct the processor to calculate a "Y" axis value for the plot of the portion of the actual curve within the portion of interest in the stratigraphic section versus the target relative depth scale by determining a difference between the starting target relative depth of the stratigraphic section and the change in target relative depth, and then subtract the true vertical depth shift from the determined difference.

The true vertical depth shift can be set by a user using the control buttons in the executive dashboard.

The plot of the portion of the actual curve within the portion of interest in the stratigraphic section versus the target relative depth scale can be displayed as one or more the relative matching graphs as described herein.

FIG. 4E is a continuation of FIG. 4D. The data storage 7 can include computer instructions 684 to instruct the processor to plot the stratigraphic cross section.

The data storage 7 can include computer instructions 686 to instruct the processor to calculate the stratigraphic cross section consisting of multiple curves representing tops of formations through which the wellbore has traversed or is expected to traverse.

In one or more embodiments, the multiple curves can represent formations through which the wellbore is expected not to traverse.

The data storage 7 can include computer instructions 688 to instruct the processor to plot curves for each formation in the stratigraphic cross section using: the true vertical depth offsets, the starting measured depth, the ending measured depth, the dip, and thicknesses from the offset/type tops table.

The data storage 7 can include computer instructions 690 to instruct the processor to determine two points along the plotted curves for each formation in the stratigraphic cross section, wherein a first point represents a starting point for a portion of the plotted curve, and a second point represents an ending point for the portion of the plotted curve, and wherein the portion of the plotted curve represents a formation within the portion of interest in the stratigraphic section. The portion of the plotted curve can be the portion of interest in the stratigraphic section. The first point can have a first X-axis value and a first Y-axis value, and the second point can have a second X-axis value and a second Y-axis value.

The data storage 7 can include computer instructions 692 to instruct the processor to use an "X" axis value of the first point of a previous stratigraphic section as the starting measured depth for the current stratigraphic section.

In one or more embodiments, the computer instructions can instruct the processor to use the second X-axis value of a previous portion of interest in the stratigraphic section as the start measured depth for a current portion of interest in the stratigraphic section.

The data storage 7 can include computer instructions 694 to instruct the processor to calculate a "Y" axis value of the first point by summing a "Y" axis value of a second point of a previous stratigraphic section and the true vertical depth offset a current stratigraphic section.

In one or more embodiments, the computer instructions can instruction the processor to calculate the first Y-axis value for the current portion of interest in the stratigraphic section by summing the second Y-axis value of the previous portion of interest in the stratigraphic section with a true vertical depth offset of the current portion of interest in the stratigraphic section. The previous portion of interest in the stratigraphic section can be the portion of interest of the stratigraphic section previously analyzed, and the current portion of interest in the stratigraphic section can be the portion of interest in the stratigraphic section currently being analyzed, wherein the previous portion of interest in the stratigraphic section has lower measured depths than the current portion of interest in the stratigraphic section.

The data storage 7 can include computer instructions 696 to instruct the processor to use an "X" axis value of the second point as the ending measured depth for the current stratigraphic section.

In one or more embodiments, the computer instructions can instruct the processor to use the second X-axis value of the current portion of interest in the stratigraphic section as an ending measured depth for the current portion of interest in the stratigraphic section.

The data storage 7 can include computer instructions 698 to instruct the processor to calculate a change in measured depth as the absolute value of the difference in the ending measured depth and the starting measured depth of the current stratigraphic section. In one or more embodiments of the calculation performed by computer instructions 698, the current stratigraphic section can be replaced with the current portion of interest in the stratigraphic section.

The data storage 7 can include computer instructions 700 to instruct the processor to calculate a change in true vertical depth by multiplying the tangent of the negation of the dip angle for the stratigraphic section with the change in measured depth of the current stratigraphic section. In one or more embodiments of the calculation performed by computer instructions 700, the stratigraphic section and the current stratigraphic section can be replaced with the current portion of interest in the stratigraphic section.

The data storage 7 can include computer instructions 702 to instruct the processor to calculate a "Y" axis value of the second point by summing a "Y" axis value of the first point and the change in true vertical depth of the current stratigraphic section. In one or more embodiment of the calculation performed by computer instructions 702, the current stratigraphic section can be replaced with the current portion of interest in the stratigraphic section.

Figure 4F:
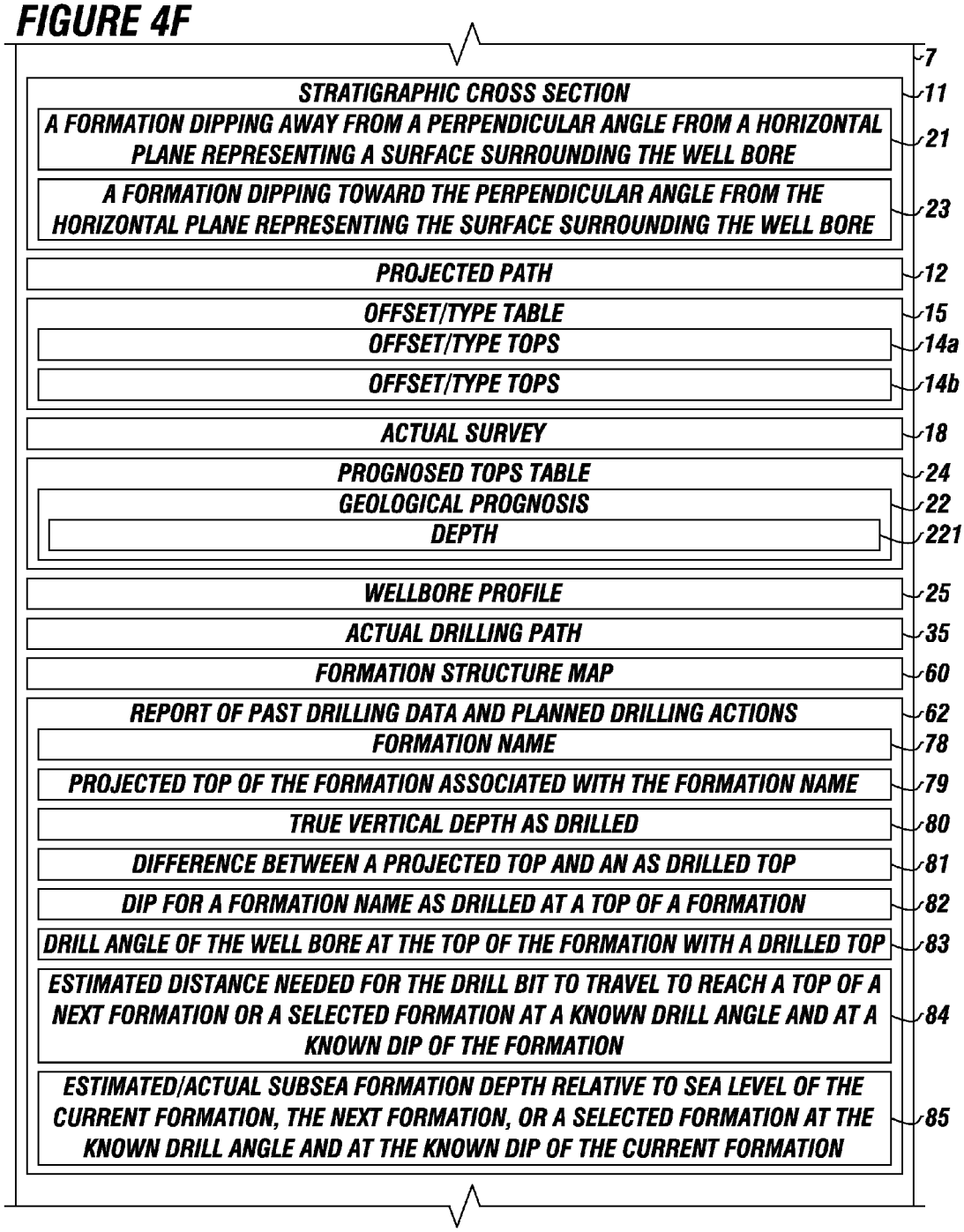

FIG. 4F is a continuation of FIG. 4E.

The data storage can include various portions of data stored therein including: the stratigraphic cross section 11 with the formation dipping away from a perpendicular angle from a horizontal plane representing a surface surrounding the wellbore 21 and the formation dipping toward the perpendicular angle from the horizontal plane representing the surface surrounding the wellbore 23; the projected path 12; the offset/type table 15 with the plurality of offset/type tops including offset/type top 14*a* and offset/type top 14*b*; the actual survey 18; the prognosed tops table 24 with the geological prognosis 22 and the depth 221; the wellbore profile 25; and the formation structure map 60.

The actual drilling path 35 can also be stored in the data storage 7. For example, during drilling actual surveys can be performed in manners well known in the art. Data from the actual surveys can be imported into the data storage 7 for use in plotting the actual drilling path.

The report of past drilling data and planned drilling actions 62 associated with the executive dashboard can be stored in the data storage 7, and can include: at least one formation name 78; at least one projected top of the formation associated with the formation name 79; at least one true vertical depth as drilled 80; at least one difference between a projected top and an as drilled top 81; at least one dip for a formation name as drilled at a top of a formation 82; at least one drill angle of the wellbore at the top of the formation with a drilled top 83; at least one estimated distance needed for the drill bit to travel to reach a top of a next formation or a selected formation at a known drill angle and at a known dip of the formation 84; and at least one estimated/actual subsea formation depth relative to sea level of the current formation, the next formation, or a selected formation at the known drill angle and at the known dip of the current formation 85.

Figure 4G:
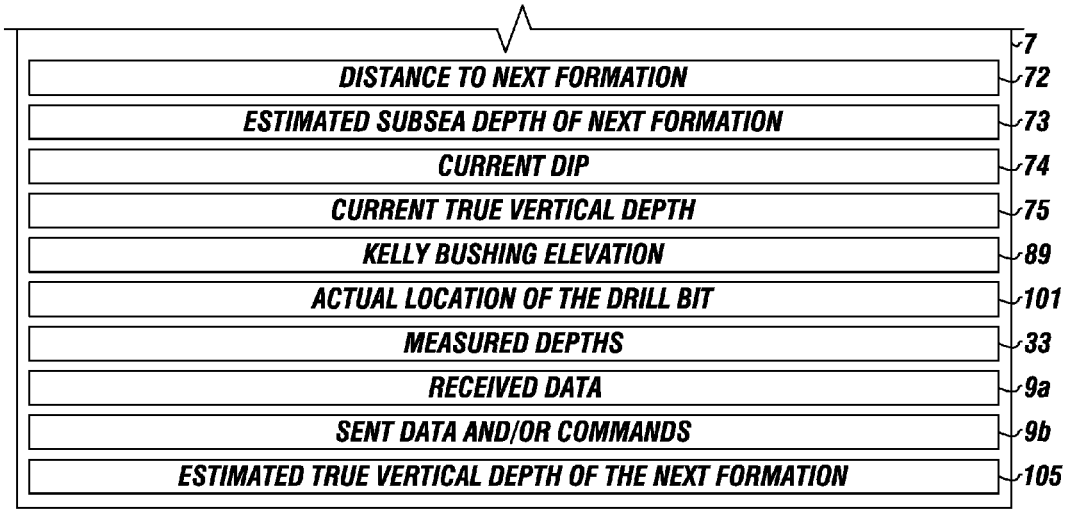

FIG. 4G is a continuation of FIG. 4F. The actual location of the drill bit 101, the estimated true vertical depth of the next formation 105, the kelly bushing elevation 89, and the estimated subsea depth of next formation 73 can all be stored in the data storage 7.

The distance to next formation 72 can be stored in the data storage 7. For example, the processor can use the current measured depth of the drill bit, the current true vertical depth of the drill bit, the current inclination of the wellbore, the current dip of the formations, and the estimated true vertical depth of the next formation to calculate the distance the wellbore must be extended to reach the next formation.

The current dip 74 can be stored in the data storage 7. For example, the current dip can be a property of a portion of interest within the stratigraphic section. In operation, given a current measured depth, the processor can determine which saved portion of interest within the data storage corresponds to the current measured depth. The processor can the retrieve the current dip associated and saved with that saved portion of interest within the data storage.

The current true vertical depth 75 can be stored in the data storage 7. The current true vertical depth can be determined by using the current measured depth and measured depths in the actual survey to: interpolate between two measured depths in the actual survey, wherein the current measured depth is a depth of the wellbore between the two measured depths; or extrapolate to the current measured depth using at least one measured depth from the actual survey.

Also stored in the data storage are: measured depths 33, received data 9*a*, and sent data and/or commands 9*b*.

FIG. 5 is presentation of a geological prognosis 22 usable in the invention. The geological prognosis 22 can include: header information 168, payzones 170, formation information 172, top depths of formations 174, base depths of formations 178, and a target line 180. For example, the header information 168 can include information about the wellbore including: contact information, identifying information for the wellbore, and other information. The payzones 170 can also be referred to as target objectives, project objectives, zones of interest, and formations of interest. The formation information 172 can include formation names, formation markers, markers, and annotated points of interest. The target line 180 can include the target true vertical depth, the target angle, and a range above and below the target depth forming a target zone. The top depths of formations 174 can be true vertical depths or measured depths. The base depths of formations 178 can be true vertical depths or measured depths.

Figure 6:
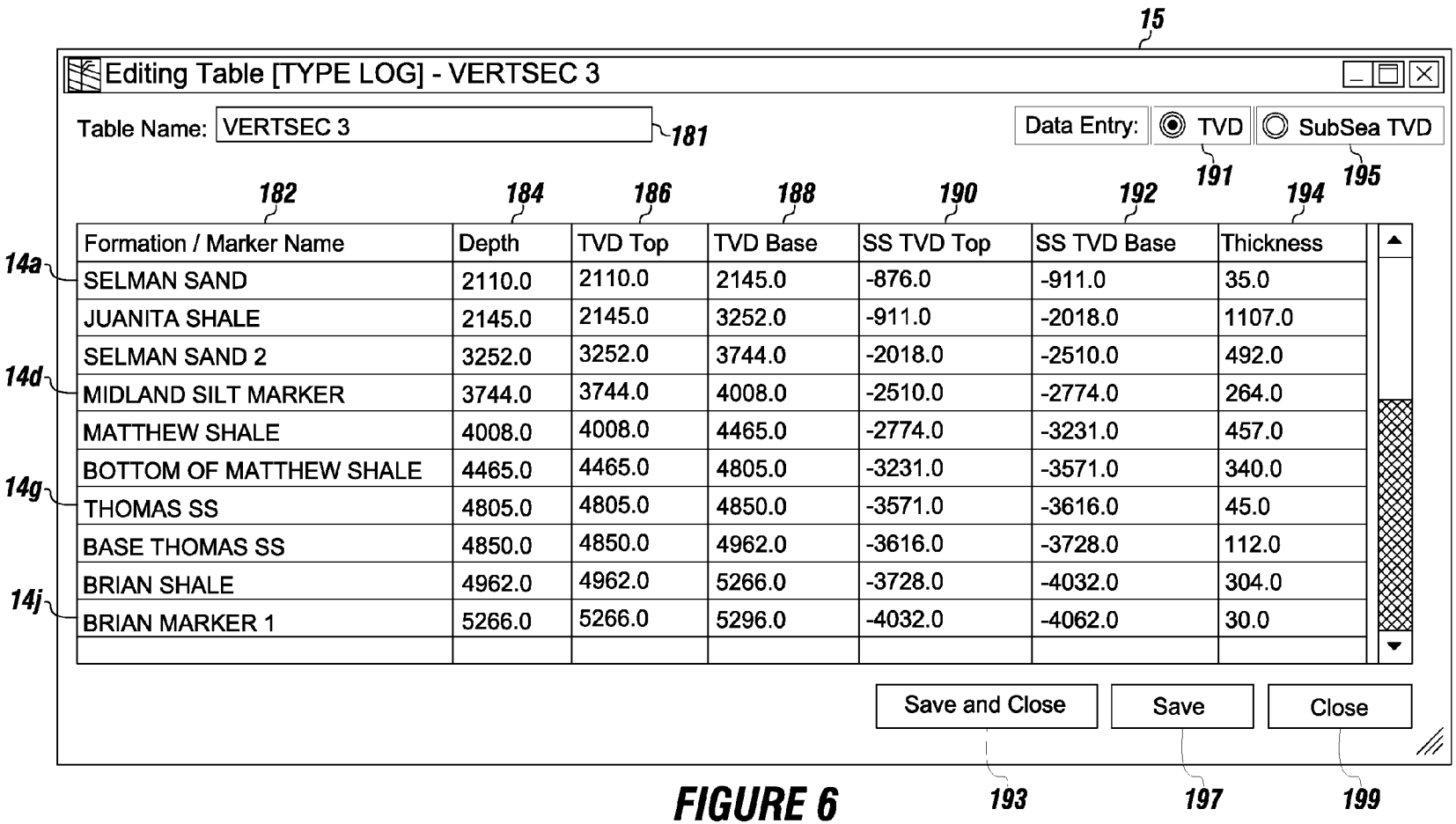
FIG. 6 is a representation of an offset/type table usable in the method.

FIG. 6 is a representation of an offset/type table 15 usable in the system usable to implement the method, including a table identifier 181 that identifies the type log tops being stored in the offset/type table.

The offset/type table 15 can include rows and columns of data. A first column of data can include formation names 182. The first column of data 182 can include a plurality of offset/type tops of a projected formation, including offset/type top 14*a*, offset/type top 14*d*, offset/type top 14*g*, and offset/type top 14*j*.

The offset/type table 15 can include: top depths of formations column 184, such as depth 2110.0 feet for the Selman Sand formation.

The offset/type table 15 can include a true vertical depth tops column 186, which can be 3744.0 for the Midland Silt marker formation.

The offset/type table 15 can include a true vertical depths base column 188, such as 4850 for the Thomas SS formation.

The offset/type table 15 can include a subsea true vertical depth tops column 190, such as −4032 for the Brian market 1 formation.

Additionally the offset/type table 15 can include a subsea true vertical depth base column 192, such as −911.0 for the Selman Sand formation, and a thickness column 194, such as 264.0 for the Midland silt marker.

The offset/type table 15 can have a first selector button 191 that allows a user to enter a true vertical depth into the top depths of formations column 184. A second selector button 195 can allow a user to enter a subsea true vertical depth into the top depths of formations column 184.

The offset/type table 15 can have three storage buttons including a save and close button 193 that can be used to save data that has been edited in the table 15 to the data storage 7 of FIG. 1, and saves the presented template of the offset/type table 15, and can remove the offset/type table 15 from the display. A save button 197 can be used to save the data that has been edited in the offset/type table 15 to the data storage 7. A close button 199 can be used to close present a template of offset/type table 15, and to remove the template from the display.

FIG. 7 is a representation of an actual survey 18 usable in the system usable to implement the method. The actual survey 18 can include: a measured depth 196; an inclination 198; an azimuth 200; a tool type 202; a survey table name 204; a proposed azimuth 206, such as 149.0 degrees; a target angle 208, such as 90 degrees; a survey calculation method 210, such as the minimum curvature method; a target true vertical depth 212, such as 6632.2; an initial value true vertical depth 214; an initial value vertical section 216; a northing 59, and an easting 220.

As an example, in one or more embodiment of the actual survey 18, calculations will not be performed in the first line of the actual survey; rather, initial values will presented here, such as: starting points, the TVD is 5824.90, the vertical section, the northing, and the easting.

The actual survey 18 can include exemplary survey points. The exemplary survey points can include the measured depths at which the actual survey is being or has been conducted, such as at 5890 feet. The actual survey 18 can show that the survey is using a gyro tool, as depicted in the tool type 202 column. For example, the gyro tool can measure the inclination as 2.3 degrees from vertical, and the azimuth can be a compass direction at 172.8 degrees when at a depth of 5890 feet. The actual survey 18 can include a save and close button, a save button, and a close button which can function the same as those described for the offset/type table depicted in FIG. 6.

Figure 8:
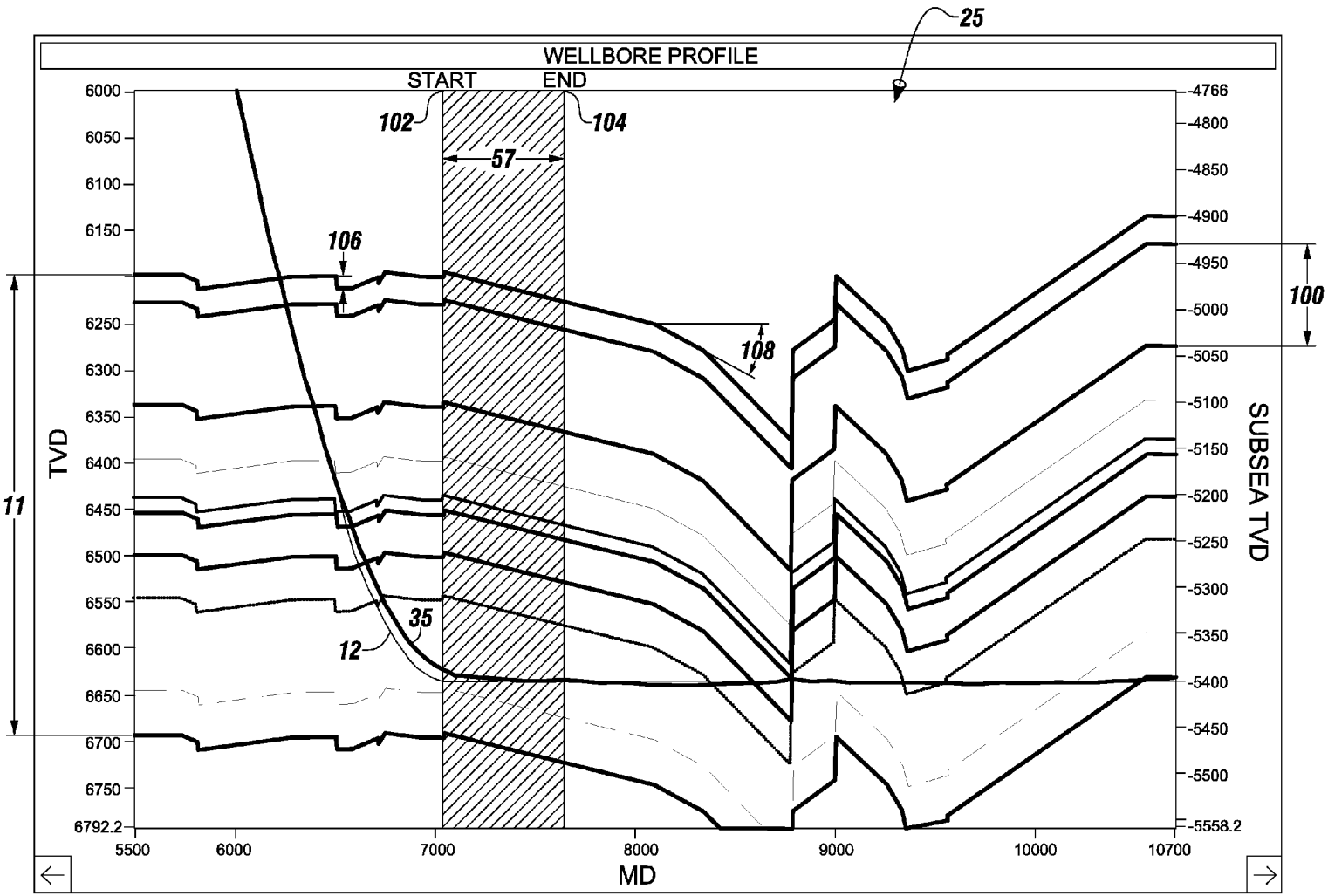
FIG. 8 is a detailed view of the stratigraphic cross section.

FIG. 8 is a detailed view of a stratigraphic cross section 11 for the wellbore profile 25. The stratigraphic cross section 11 can include: a projected path 12 for a drilling bit, an actual path 35 for the drilling bit, a true vertical depth offset for the stratigraphic cross section of the wellbore 106, a dip angle for the stratigraphic cross section of the wellbore 108, which is shown as a dip away that is approximately a 30 degree angle. The stratigraphic cross section 11 can include: one of the offset type tops sections through which the projected path will follow 100, a starting measured depth 102 for a stratigraphic section 57 of the wellbore, and an ending measured depth 104 for the stratigraphic section 57.

Figure 9:
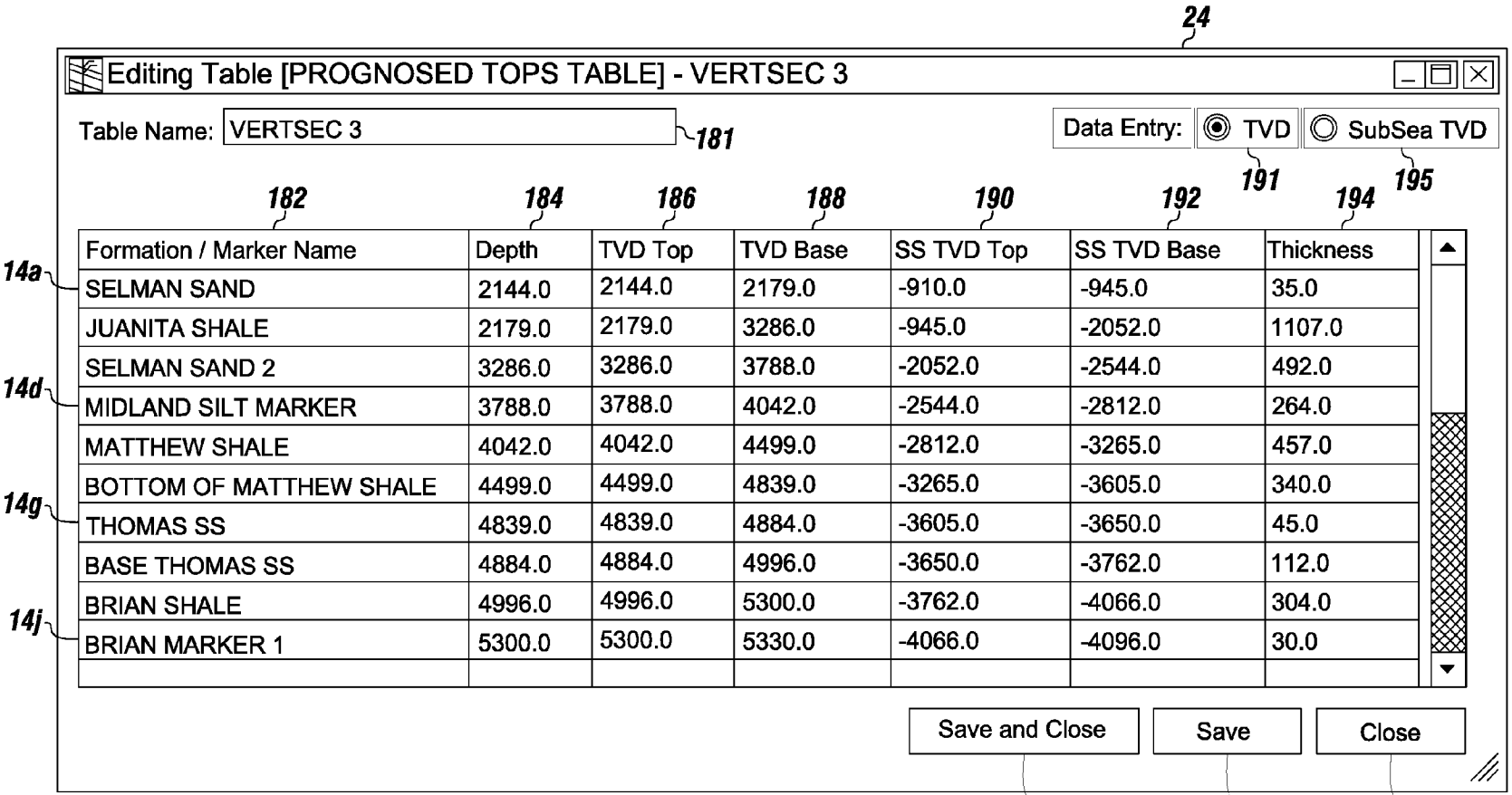
FIG. 9 depicts an embodiment of a prognosed tops table.

FIG. 9 depicts an embodiment of a prognosed tops table 24.

The prognosed tops table 24 can include a table identifier 181 that identifies the type log tops being stored in the prognosed tops table 24.

The prognosed tops table 24 can include rows and columns of data. A first column of data can include formation names 182. The first column of data 182 can include a plurality of offset/type tops of a projected formation, including offset/type top 14*a*, offset/type top 14*d*, offset/type top 14*g*, and offset/type top 14*j*.

The prognosed tops table 24 can include: top depths of formations column 184, such as depth 2110.0 feet for the Selman Sand formation.

The prognosed tops table 24 can include a true vertical depth tops column 186, which can be 3744.0 for the Midland Silt marker formation.

The prognosed tops table 24 can include a true vertical depths base column 188, such as 4850 for the Thomas SS formation.

The prognosed tops table 24 can include a subsea true vertical depth tops column 190, such as −4032 for the Brian market 1 formation.

Additionally the prognosed tops table 24 can include a subsea true vertical depth base column 192, such as −911.0 for the Selman Sand formation, and a thickness of formation column 194, such as 264.0 for the Midland silt marker.

The prognosed tops table 24 can have a first selector button 191 that allows a user to enter a true vertical depth into the top depths of formations column 184. A second selector button 195 can allow a user to enter a subsea true vertical depth into the top depths of formations column 184.

The prognosed tops table 24 can have three storage buttons including a save and close button 193 that can be used to save data that has been edited in the prognosed tops table to the data storage 7 of FIG. 1, and saves the presented template of the prognosed tops table, and can remove the prognosed tops table 24 from the display. A save button 197 can be used to save the data that has been edited in the prognosed tops table 24 to the data storage 7. A close button 199 can be used to close the prognosed tops table 24, and to remove the prognosed tops table from the display.

FIGS. 10A-10E depict an embodiment of a method for geosteering during directional drilling of a wellbore that can be implemented using one or more embodiment of the system disclosed herein.

Figure 10A:
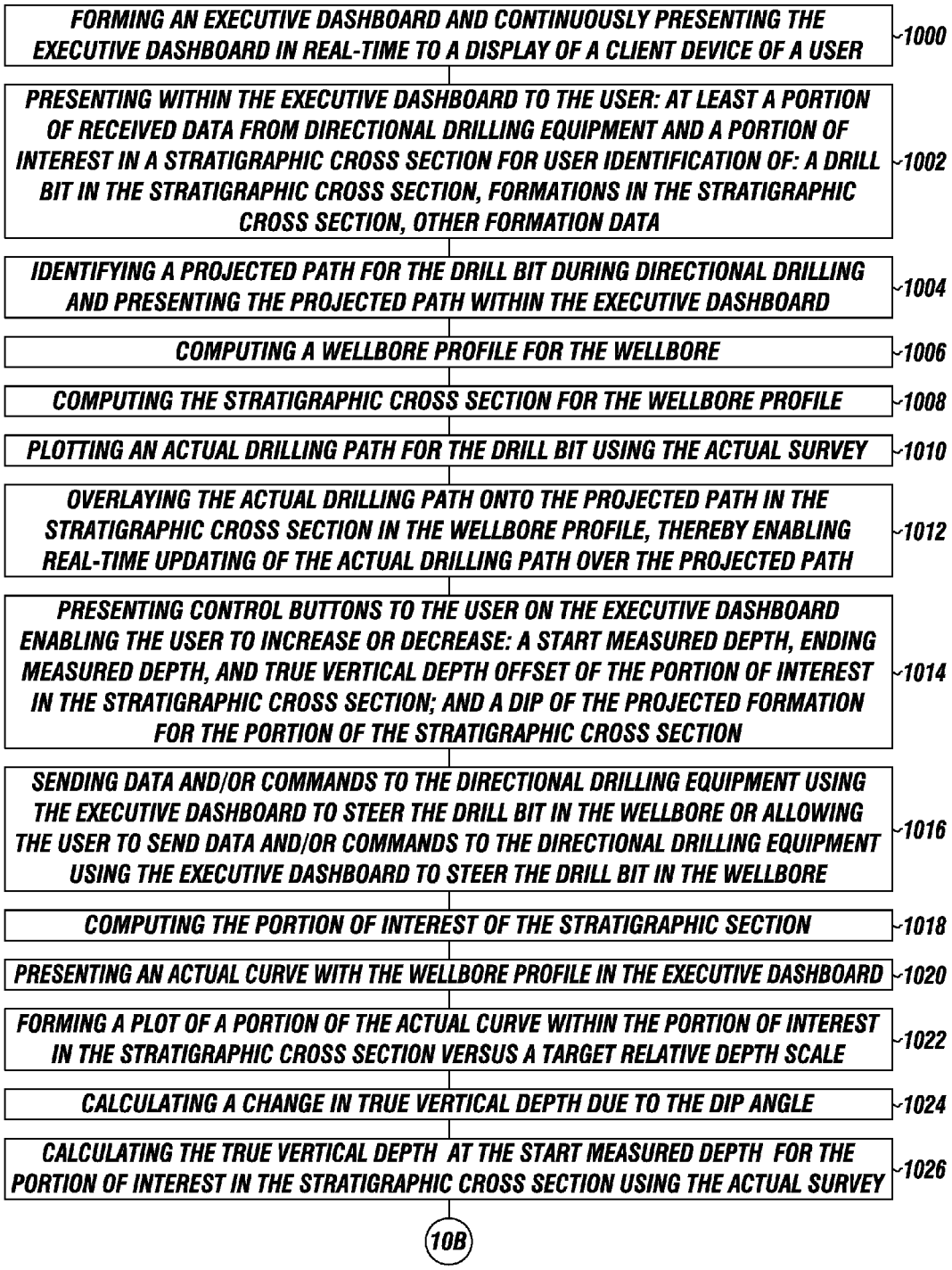
FIGS. 10A-10E is a flow chart of an embodiment of a method that can be implemented using the system.

FIG. 10A shows that the method can include forming an executive dashboard and continuously presenting the executive dashboard in real-time to a display of a client device of a user, as illustrated by box 1000.

The method can include presenting within the executive dashboard to the user: at least a portion of received data from directional drilling equipment and a portion of interest in a stratigraphic cross section for user identification of: a drill bit in the stratigraphic cross section, formations in the stratigraphic cross section, other formation data, as illustrated by box 1002.

The method can include identifying a projected path for the drill bit during directional drilling and presenting the projected path within the executive dashboard, as illustrated by box 1004.

The method can include computing a wellbore profile for the wellbore, as illustrated by box 1006.

For example, the wellbore profile can be computed using: an offset/type table including a plurality of offset/type tops of a projected formation through which the projected path is expected to pass; an actual survey of the wellbore; and a geological prognosis from a prognosed tops table comprising at least one depth for at least one formation top through which the projected path is expected to pass, wherein the wellbore profile is a composite visualization of a plurality of true vertical depths.

The method can include computing the stratigraphic cross section for the wellbore profile, as illustrated by box 1008.

For example, the stratigraphic cross section can be computed using the imported data, wherein the stratigraphic cross section comprises: a formation dipping away from a perpendicular angle from a horizontal plane representing a surface surrounding the wellbore; a formation dipping toward the perpendicular angle from the horizontal plane representing the surface surrounding the wellbore; or combinations thereof.

The method can include plotting an actual drilling path for the drill bit using the actual survey, as illustrated by box 1010.

The method can include overlaying the actual drilling path onto the projected path in the stratigraphic cross section in the wellbore profile, thereby enabling real-time updating of the actual drilling path over the projected path, as illustrated by box 1012.

The method can include presenting control buttons to the user on the executive dashboard enabling the user to increase or decrease: a start measured depth, ending measured depth, and true vertical depth offset of the portion of interest in the stratigraphic cross section; and a dip of the projected formation for the portion of the stratigraphic cross section, as illustrated by box 1014.

The method can include sending data and/or commands to the directional drilling equipment using the executive dashboard to steer the drill bit in the wellbore or allowing the user to send data and/or commands to the directional drilling equipment using the executive dashboard to steer the drill bit in the wellbore, as illustrated by box 1016.

The method can include computing the portion of interest of the stratigraphic section, as illustrated by box 1018.

For example, the portion of interest of the stratigraphic section can be computed using: one of the plurality of offset/type tops of the projected formation through which the projected path is expected to pass; the start measured depth; the ending measured depth; the true vertical depth offset; and the dip angle.

The method can include presenting an actual curve with the wellbore profile in the executive dashboard, as illustrated by box 1020.

The method can include forming a plot of a portion of the actual curve within the portion of interest in the stratigraphic cross section versus a target relative depth scale, as illustrated by box 1022.

The method can include calculating a change in true vertical depth due to the dip angle, as illustrated by box 1024.

The method can include calculating the true vertical depth at the start measured depth for the portion of interest in the stratigraphic cross section using the actual survey, as illustrated by box 1026.

Figure 10B:
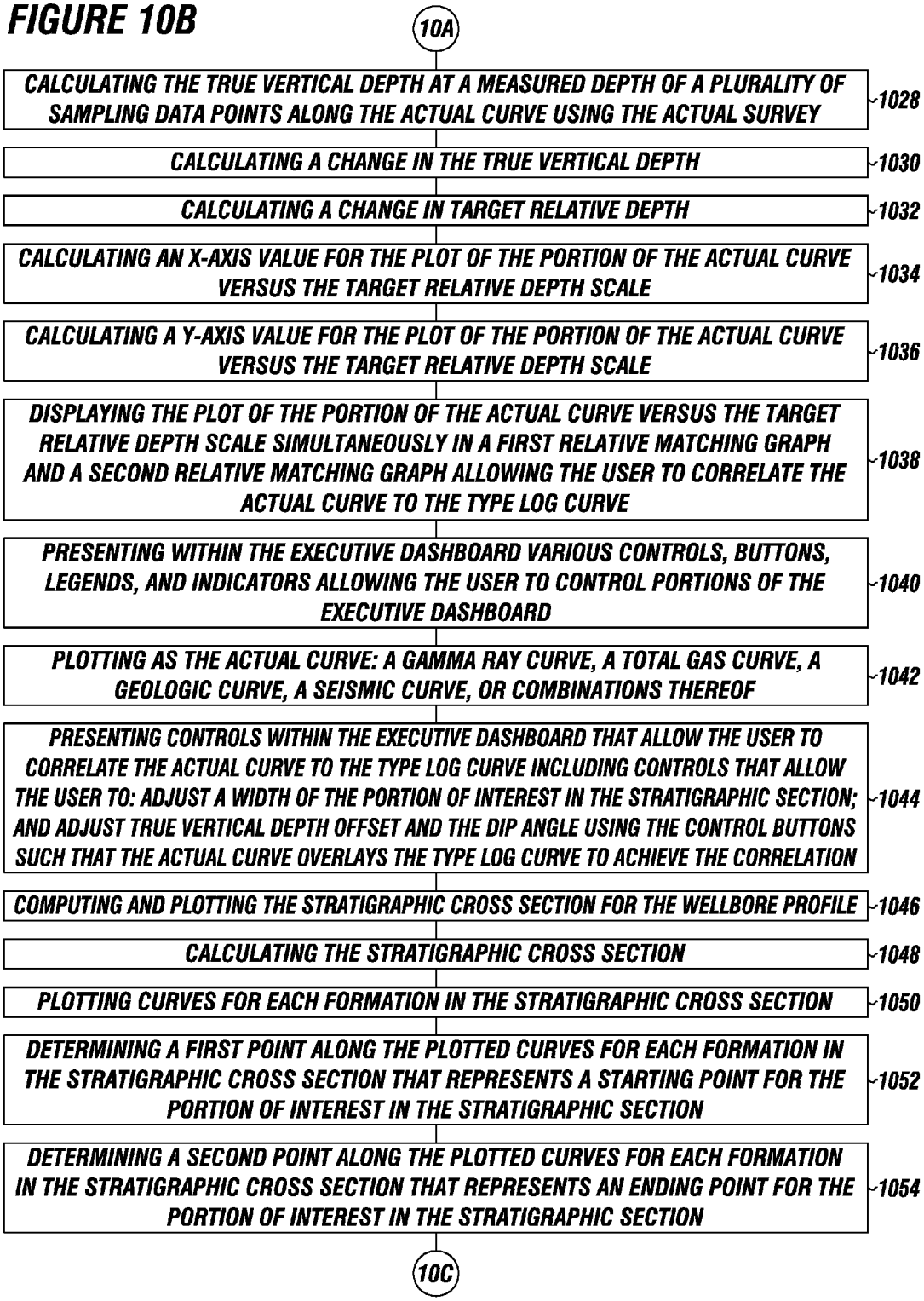

FIG. 10B is a continuation of FIG. 10A. The method can include calculating the true vertical depth at a measured depth of a plurality of sampling data points along the actual curve using the actual survey, as illustrated by box 1028.

The method can include calculating a change in the true vertical depth, as illustrated by box 1030.

For example, the change in the true vertical depth can be calculated by determining a difference between the true vertical depth at the start measured depth and the true vertical depth at the measured depth of each of the plurality of sampling data points along the actual curve.

The method can include calculating a change in target relative depth, as illustrated by box 1032.

For example, the change in target relative depth can be calculated by performing a summation of the change in true vertical depth using the dip angle and the change in true vertical depth.

The method can include calculating an X-axis value for the plot of the portion of the actual curve versus the target relative depth scale, as illustrated by box 1034.

For example, the X-axis value can be calculated by multiplying an actual value of one of the plurality of data points with an actual scale factor.

The method can include calculating a Y-axis value for the plot of the portion of the actual curve versus the target relative depth scale, as illustrated by box 1036.

For example, the Y-axis value can be calculated by subtracting a starting target relative depth of the portion of interest in the stratigraphic cross section from a change in target relative depth forming a difference, and then subtracting a true vertical depth shift from the difference.

The method can include displaying the plot of the portion of the actual curve versus the target relative depth scale simultaneously in a first relative matching graph and a second relative matching graph allowing the user to correlate the actual curve to the type log curve, as illustrated by box 1038.

The method can include presenting within the executive dashboard various controls, buttons, legends, and indicators allowing the user to control portions of the executive dashboard, as illustrated by box 1040.

For example, the various controls, buttons, legends, and indicators can include: an actual scale factor button allowing the user to increase or decrease the scale factor of the actual curve for both of the relative matching graphs; a control button to set, change, increase, or decrease a starting true vertical depth offset of the type log curve for both of the relative matching graphs; a control button for each of the relative matching graphs allowing the user to depth zoom-in; a control button for each of the relative matching graphs allowing the user to depth zoom-out; a control button 6 for each of the relative matching graphs allowing the user to value zoom-in; a control button for each of the relative matching graphs allowing the user to value zoom-out; a control button for each of the relative matching graphs allowing the user to scroll up along each relative matching graph; a control button for each of the relative matching graphs allowing the user to scroll down along each relative matching graph; a control button to add stratigraphic cross sections to the wellbore profile; a control button to delete stratigraphic cross sections from the wellbore profile; a first indicator to identify dipping away from the projected path; a second indicator to identify dipping towards the projected path; a first navigation control for moving the portion of interest in the stratigraphic section in a first direction along the stratigraphic cross section; a second navigation control for moving portion of interest in the stratigraphic section in a second direction along the stratigraphic cross section; a legend showing: a planned wellbore, an actual wellbore, formation names, a current formation name, a next formation name, total gas curves, gamma ray curves, or other curves; at least one speed control button to control a rate of adjustment for at least one of the control buttons; and combinations thereof.

The method can include plotting as the actual curve: a gamma ray curve, a total gas curve, a geologic curve, a seismic curve, or combinations thereof, as illustrated by box 1042.

The method can include presenting a toolbar within the executive dashboard allowing the user to perform tasks.

The toolbar can include various drop down menus to perform various tasks as described in FIG. 2.

The method can include presenting controls within the executive dashboard that allow the user to correlate the actual curve to the type log curve including controls that allow the user to: adjust a width of the portion of interest in the stratigraphic section; and adjust true vertical depth offset and the dip angle using the control buttons such that the actual curve overlays the type log curve to achieve the correlation, as illustrated by box 1044.

The method can include computing and plotting the stratigraphic cross section for the wellbore profile, as illustrated by box 1046.

The method can include calculating the stratigraphic cross section, as illustrated by box 1048.

The stratigraphic cross section consists of multiple curves representing tops of formations through which the wellbore has traversed, is expected to traverse, is expected to not traverse, or combinations thereof.

The method can include plotting curves for each formation in the stratigraphic cross section, as illustrated by box 1050.

For example, the plotting of curves for each formation in the stratigraphic cross section can use: true vertical depth offsets from the portion of interest in the stratigraphic section, start measured depths from the portion of interest in the stratigraphic section, ending measured depths from the portion of interest in the stratigraphic section, dips from the portion of interest in the stratigraphic section, and thicknesses from the offset/type tops table.

The method can include determining a first point along the plotted curves for each formation in the stratigraphic cross section that represents a starting point for the portion of interest in the stratigraphic section, as illustrated by box 1052.

The method can include determining a second point along the plotted curves for each formation in the stratigraphic cross section that represents an ending point for the portion of interest in the stratigraphic section, as illustrated by box 1054.

Figure 10C:
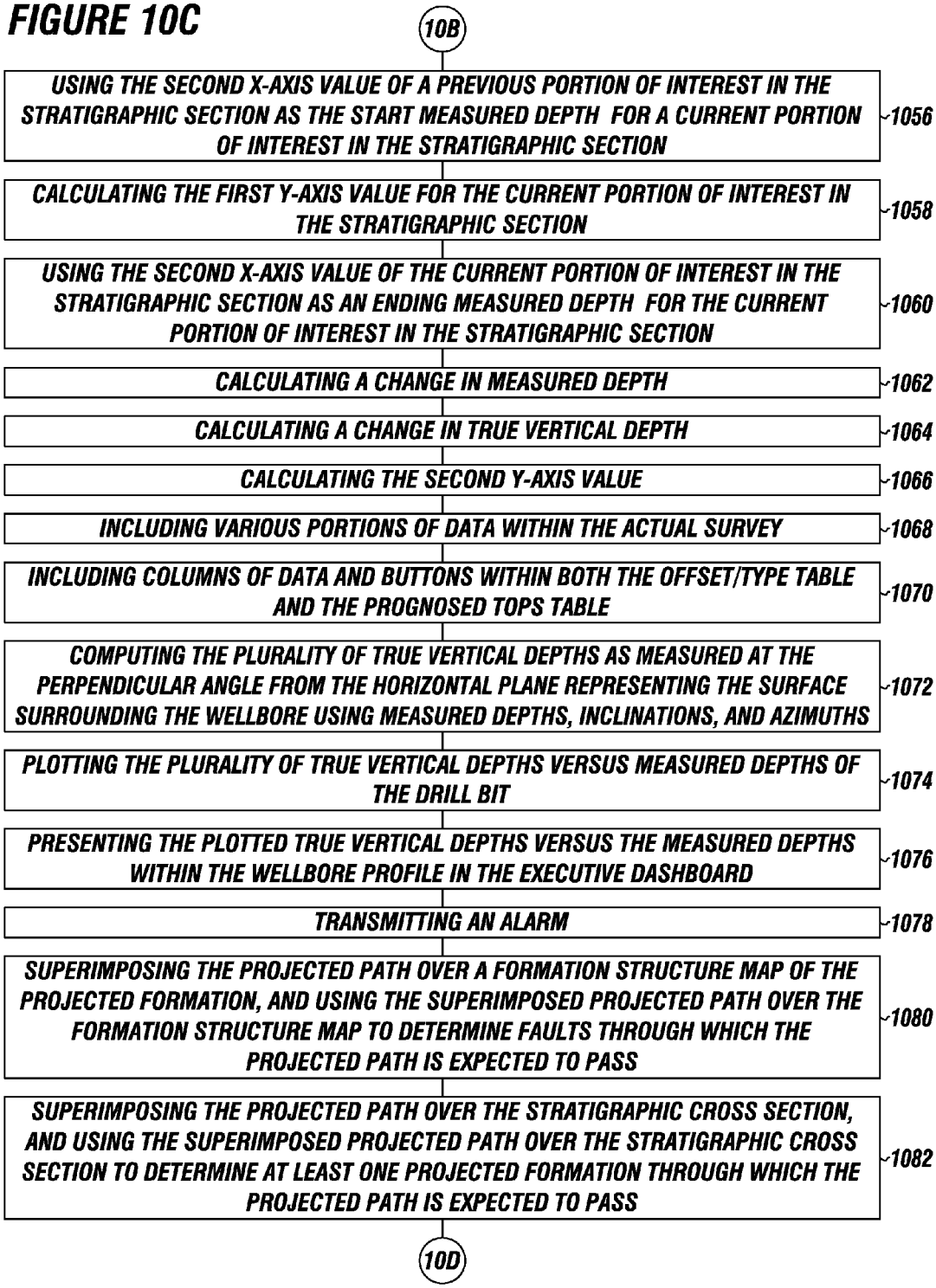

FIG. 10C is a continuation of FIG. 10B. The portion of interest in the stratigraphic section can represent a formation within the portion of interest in the stratigraphic cross section. The first point can include a first X-axis value and a first Y-axis value, and the second point can include a second X-axis value and a second Y-axis value.

The method can include using the second X-axis value of a previous portion of interest in the stratigraphic section as the start measured depth for a current portion of interest in the stratigraphic section, as illustrated by box 1056.

The method can include calculating the first Y-axis value for the current portion of interest in the stratigraphic section, as illustrated by box 1058.

For example, the first Y-axis value for the current portion of interest in the stratigraphic section can be calculated by summing the second Y-axis value of the previous portion of interest in the stratigraphic section with a true vertical depth offset of the current portion of interest in the stratigraphic section.

The method can include using the second X-axis value of the current portion of interest in the stratigraphic section as an ending measured depth for the current portion of interest in the stratigraphic section, as illustrated by box 1060.

The method can include calculating a change in measured depth, as illustrated by box 1062.

For example the change in measured depth can be calculated as an absolute value of a difference in the ending measured depth and the starting measured depth of the current portion of interest in the stratigraphic section.

The method can include calculating a change in true vertical depth, as illustrated by box 1064.

For example, the change in true vertical depth can be calculated by multiplying a tangent of a negation of a dip angle for the current portion of interest in the stratigraphic section with the change in measured depth of the current portion of interest in the stratigraphic section.

The method can include calculating the second Y-axis value, as illustrated by box 1066.

For example, the second Y-axis value can be calculated by summing the first Y-axis value and the change in true vertical depth of the current portion of interest in the stratigraphic section.

The method can include: including various portions of data within the actual survey, as illustrated by box 1068.

For example, the various portions of data can include a member of the group consisting of: a measured depth, an inclination, an azimuth, a tool type, a survey table name, a proposed azimuth, a target angle, a survey calculation method, a target true vertical depth, an initial true vertical depth, an initial vertical section, an initial northing, an initial easting, and combinations thereof.

The method can include: including columns of data and buttons within both the offset/type table and the prognosed tops table, as illustrated by box 1070.

For example, the offset/type table and the prognosed tops table can include the columns of data and buttons shown in FIGS. 6 and 9 herein.

The method can include computing the plurality of true vertical depths as measured at the perpendicular angle from the horizontal plane representing the surface surrounding the wellbore using measured depths, inclinations, and azimuths, as illustrated by box 1072.

The method can include plotting the plurality of true vertical depths versus measured depths of the drill bit, as illustrated by box 1074.

The method can include presenting the plotted true vertical depths versus the measured depths within the wellbore profile in the executive dashboard, as illustrated by box 1076.

The method can include transmitting an alarm, as illustrated by box 1078.

For example, an alarm can be transmitted if continued drilling in a formation: will violate a permit, will pose a safety hazard, will be an economic hazard, or combinations thereof, wherein the alarm is transmitted to the client device of the user.

The method can include superimposing the projected path over a formation structure map of the projected formation, and using the superimposed projected path over the formation structure map to determine faults through which the projected path is expected to pass, as illustrated by box 1080.

The method can include superimposing the projected path over the stratigraphic cross section, and using the superimposed projected path over the stratigraphic cross section to determine at least one projected formation through which the projected path is expected to pass, as illustrated by box 1082.

FIG. 10 D is a continuation of FIG. 10C. The method can include forming a report of the projected path and the actual drilling path, and presenting the report of the projected path and the actual drilling path in the executive dashboard to be viewed in real-time by a plurality of users simultaneously, as illustrated by box 1084.

The method can include presenting current information within the executive dashboard for simultaneous display to the plurality of users, as illustrated by box 1086.

The method can include forming a report of past drilling data and planned drilling actions and presenting the report of past drilling data and planned drilling actions within the display, as illustrated by box 1088.

The method can include displaying in the executive dashboard an actual location of the drill bit on the actual drilling path in the wellbore profile for instantaneous identification of the drill bit, as illustrated by box 1090.

The method can include plotting the subsea true vertical depth against: the true vertical depth, the start measured depth, and the ending measured depth; and including the plot of the subsea true vertical depth within the wellbore profile, as illustrated by box 1092.

The method can include determining the projected formation using a geological hypothesis of an actual geological formation, as illustrated by box 1094.

The method can include generating the geological prognosis using a surface elevation or a rotary table bushing elevation of the surface for a start of the wellbore and at least one offset/type top of the projected formation; or allowing the user to provide the geological prognosis, as illustrated by box 1096.

The method can include using offset/type log tops from a vertical well proximate the wellbore to calculate thicknesses of formations, thicknesses of rock between formations, other geological features, or combinations thereof, as illustrated by box 1098.

The method can include including a type log in each of the plurality of offset/type tops, as illustrated by box 1100.

The method can include generating the projected path by calculating the projected path using a kick off point, a build rate, a landing point, and a target angle; or allowing the user to provide the projected path, as illustrated by box 1102.

The method can include providing correlation points for at least one actual curve or at least one point along the actual curve of the stratigraphic cross section, and tying each correlation point to a known type log curve for confirming: accuracy of the actual curve, accuracy of a fit of the actual curve to the known type log curve, or combinations thereof, as illustrated by box 1104.

Figure 10D:
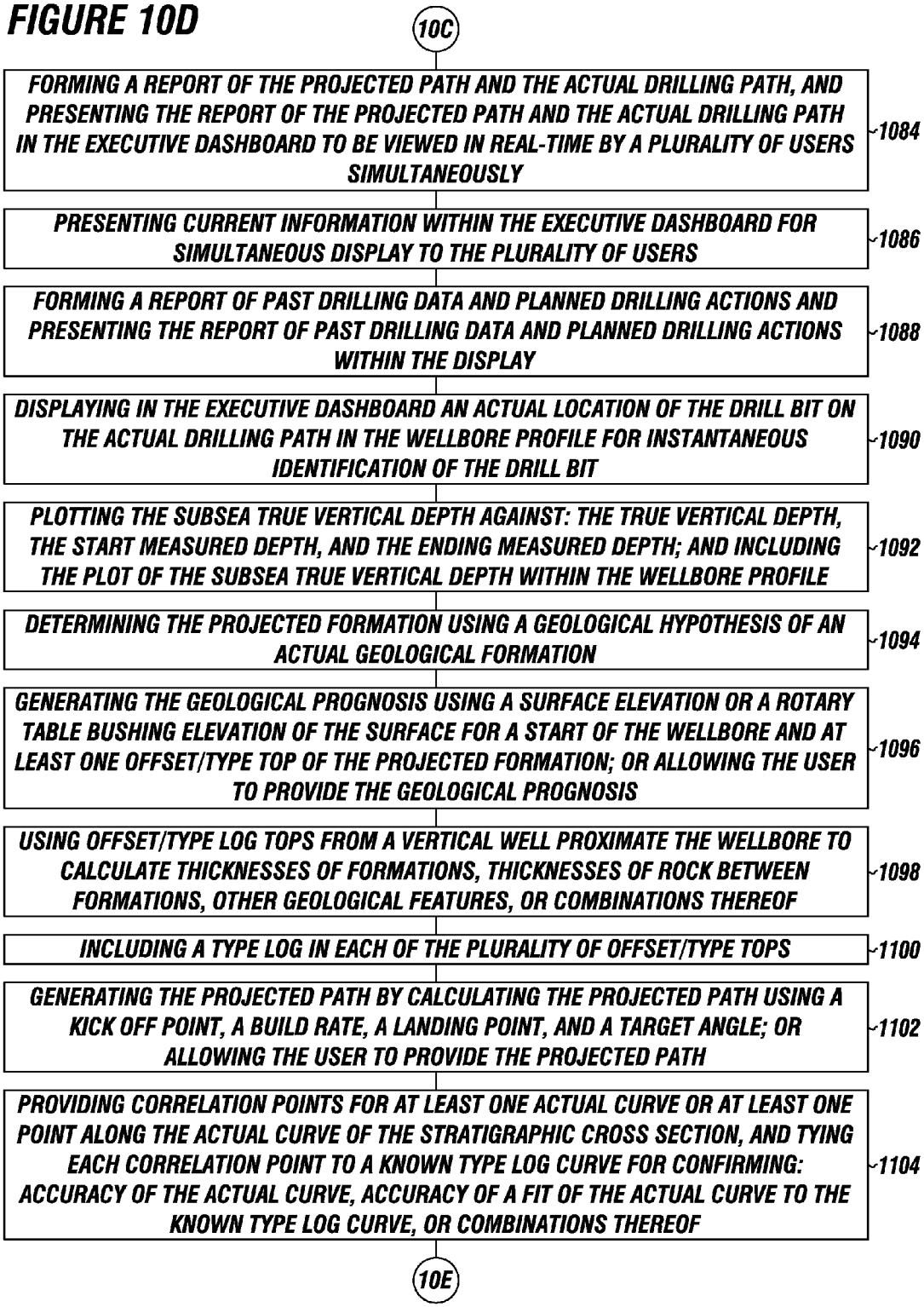
Figure 10E:
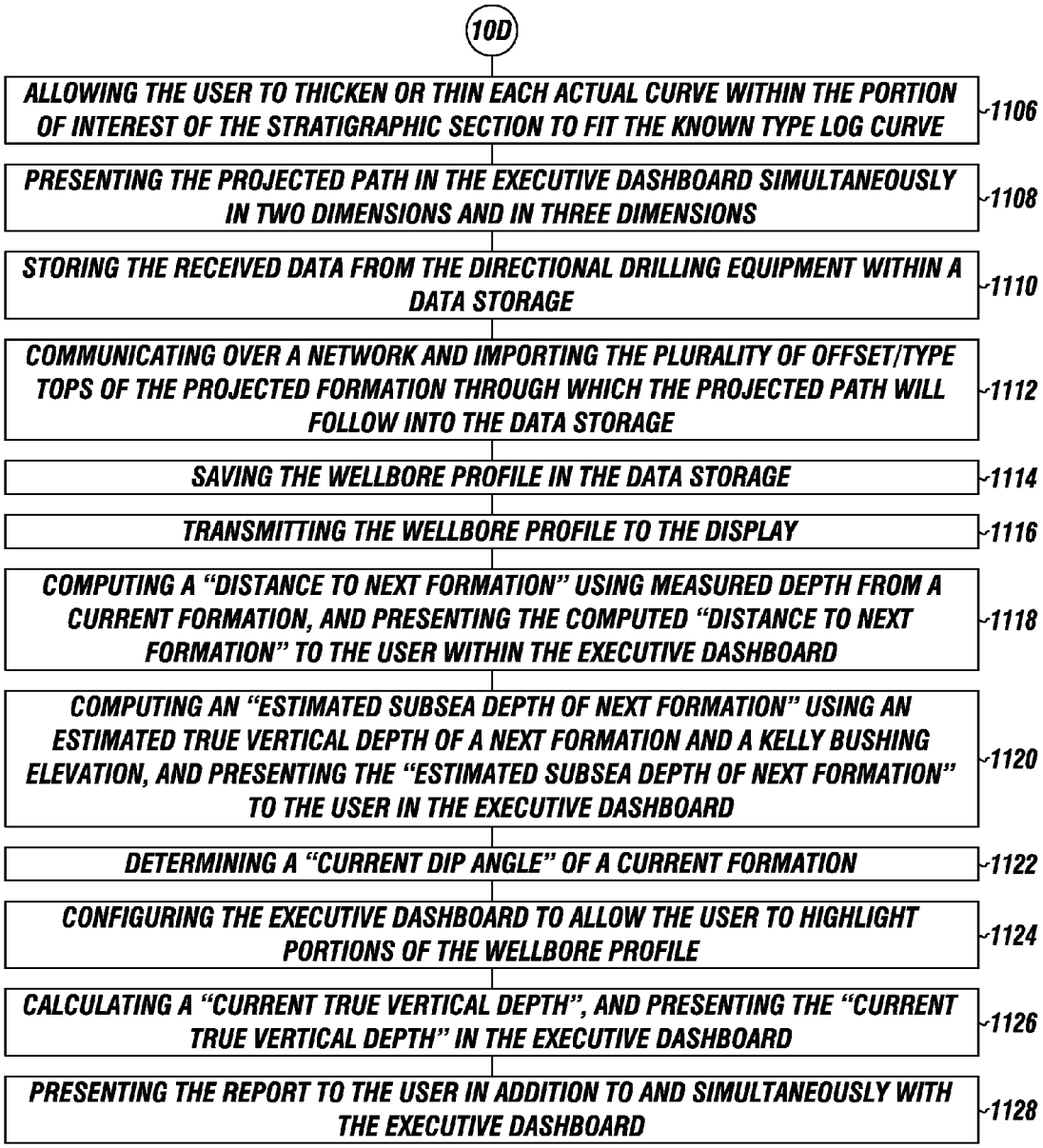

FIG. 10E is a continuation of FIG. 10D. The method can include allowing the user to thicken or thin each actual curve within the portion of interest of the stratigraphic section to fit the known type log curve, as illustrated by box 1106.

The method can include presenting the projected path in the executive dashboard simultaneously in two dimensions and in three dimensions, as illustrated by box 1108.

The method can include storing the received data from the directional drilling equipment within a data storage, as illustrated by box 1110.

The method can include communicating over a network and importing the plurality of offset/type tops of the projected formation through which the projected path will follow into the data storage, as illustrated by box 1112.

The method can include saving the wellbore profile in the data storage, as illustrated by box 1114.

The method can include transmitting the wellbore profile to the display, as illustrated by box 1116.

The method can include computing a "distance to next formation" using measured depth from a current formation, and presenting the computed "distance to next formation" to the user within the executive dashboard, as illustrated by box 1118.

The method can include computing an "estimated subsea depth of next formation" using an estimated true vertical depth of a next formation and a kelly bushing elevation, and presenting the "estimated subsea depth of next formation" to the user in the executive dashboard, as illustrated by box 1120.

The method can include determining a "current dip angle" of a current formation, as illustrated by box 1122.

The method can include configuring the executive dashboard to allow the user to highlight portions of the wellbore profile, as illustrated by box 1124.

The method can include calculating a "current true vertical depth", and presenting the "current true vertical depth" in the executive dashboard, as illustrated by box 1126.

The method can include presenting the report to the user in addition to and simultaneously with the executive dashboard, as illustrated by box 1128.

While these embodiments have been described with emphasis on the embodiments, it should be understood that within the scope of the appended claims, the embodiments might be practiced other than as specifically described herein.

What is claimed is:

1. A method for geosteering during directional drilling of a wellbore, the method comprising:

(a) forming an executive dashboard and presenting the executive dashboard in real-time to a display of a client device of a user;

(b) presenting the executive dashboard to the user: at least a portion of received data from directional drilling equipment, at least a portion of interest in a stratigraphic cross section for user identification of: a drill bit in the stratigraphic cross section, formations in the stratigraphic cross section, other formation data, or combinations thereof;

(c) identifying a projected path for the drill bit during directional drilling and presenting the projected path within the executive dashboard;

(d) computing a wellbore profile for the wellbore using imported data, wherein the imported data comprises:

(i) an offset/type table including a plurality of offset/type tops of a projected formation through which the projected path is expected to pass;

(ii) an actual survey of the wellbore; and (iii) a geological prognosis from a prognosed tops table comprising at least one depth for at least one formation top through which the projected path is expected to pass, wherein the wellbore profile is a composite visualization of a plurality of true vertical depths;

(e) computing the stratigraphic cross section for the wellbore profile using the imported data, wherein the stratigraphic cross section comprises:

(i) a formation dipping away from an angle perpendicular to a horizontal plane representing a surface surrounding the wellbore;

(ii) a formation dipping toward the angle perpendicular to the horizontal plane representing the surface surrounding the wellbore; or (iii) combinations thereof;

(f) plotting an actual drilling path for the drill bit using the actual survey;

(g) overlaying the actual drilling path onto the stratigraphic cross section in the wellbore profile, thereby enabling real-time updating of the actual drilling path; and (h) presenting control buttons to the user on the executive dashboard enabling the user to increase or decrease a member of the group consisting of: a start measured depth of the wellbore, an ending measured depth of the wellbore, a true vertical depth offset of the wellbore, a dip of the projected formation, and combinations thereof for the portion of interest in the stratigraphic cross section; and (i) wherein the stratigraphic cross section for the wellbore profile is further computed and plotted by:

(i) calculating the stratigraphic cross section, wherein the stratigraphic cross section consists of multiple curves representing tops of formations through which the wellbore has traversed, is expected to traverse, is expected to not traverse, or combinations thereof;

(ii) plotting curves for each formation in the stratigraphic cross section using: true vertical depth offsets from the portion of interest in the stratigraphic section, start measured depths from the portion of interest in the stratigraphic section, ending measured depths from the portion of interest in the stratigraphic section, dips from the portion of interest in the stratigraphic section, and thicknesses from the offset/type tops table;

(iii) determining a first point along the plotted curves for each formation in the stratigraphic cross section that represents a starting point for the portion of interest in the stratigraphic section;

(iv) determining a second point along the plotted curves for each formation in the stratigraphic cross section that represents an ending point for the portion of interest in the stratigraphic section, wherein the portion of interest in the stratigraphic section represents a formation within the portion of interest in the stratigraphic cross section, wherein the first point comprises a first X-axis value and a first Y-axis value, and wherein the second point comprises a second X-axis value and a second Y-axis value;

(v) using the second X-axis value of a previous portion of interest in the stratigraphic section as the start measured depth for a current portion of interest in the stratigraphic section;

(vi) calculating the first Y-axis value for the current portion of interest in the stratigraphic section by summing the second Y-axis value of the previous portion of interest in the stratigraphic section with a true vertical depth offset of the current portion of interest in the stratigraphic section;

(vii) using the second X-axis value of the current portion of interest in the stratigraphic section as an ending measured depth for the current portion of interest in the stratigraphic section;

(viii) calculating a change in measured depth as an absolute value of a difference in the ending measured depth and the starting measured depth of the current portion of interest in the stratigraphic section;

(ix) calculating a change in true vertical depth by multiplying a tangent of a negation of a dip angle for the current portion of interest in the stratigraphic section with the change in measured depth of the current portion of interest in the stratigraphic section; and (x) calculating the second Y-axis value by summing the first Y-axis value and the change in true vertical depth of the current portion of interest in the stratigraphic section.

2. The method of claim 1, further comprising sending data, commands, or combinations thereof to the directional drilling equipment using the executive dashboard to steer the drill bit in the wellbore or allowing the user to send data, commands, or combinations thereof to the directional drilling equipment using the executive dashboard to steer the drill bit in the wellbore.

3. The method of claim 1, further comprising computing the portion of interest of the stratigraphic section using:

(a) one of the plurality of offset/type tops of the projected formation through which the projected path is expected to pass;

(b) the start measured depth;

(c) the ending measured depth;

(d) the true vertical depth offset; and (e) the dip angle.

4. The method of claim 1, further comprising:

(a) presenting an actual curve with the wellbore profile in the executive dashboard;

(b) forming a plot of a portion of the actual curve within the portion of interest in the stratigraphic cross section versus a target relative depth scale;

(c) calculating a change in true vertical depth due to the dip angle;

(d) calculating the true vertical depth at the start measured depth for the portion of interest in the stratigraphic cross section using the actual survey;

(e) calculating the true vertical depth at a measured depth of a plurality of sampling data points along the actual curve using the actual survey;

(f) calculating a change in the true vertical depth by determining a difference between the true vertical depth at the start measured depth and the true vertical depth at the measured depth of each of the plurality of sampling data points along the actual curve;

(g) calculating a change in target relative depth by performing a summation of the change in true vertical depth using the dip angle and the change in true vertical depth;

(h) calculating an X-axis value for the plot of the portion of the actual curve versus the target relative depth scale, wherein the X-axis value is calculated by multiplying an actual value of one of the plurality of data points with an actual scale factor;

(i) calculating a Y-axis value for the plot of the portion of the actual curve versus the target relative depth scale, wherein the Y-axis value is calculated by subtracting a starting target relative depth of the stratigraphic cross section from a change in target relative depth forming a difference, and then subtracting a true vertical depth shift from the difference; and (j) displaying the plot of the portion of the actual curve versus the target relative depth scale simultaneously in a first relative matching graph and a second relative matching graph allowing the user to correlate the actual curve to the type log curve.

5. The method of claim 4, further comprising presenting within the executive dashboard a member of the group consisting of:

(a) an actual scale factor button allowing the user to increase or decrease the scale factor of the actual curve for both of the relative matching graphs;

(b) a control button to set, change, increase, or decrease a starting true vertical depth offset of the type log curve for both of the relative matching graphs;

(c) a control button for each of the relative matching graphs allowing the user to depth zoom-in;

(d) a control button for each of the relative matching graphs allowing the user to depth zoom-out;

(e) a control button for each of the relative matching graphs allowing the user to value zoom-in;

(f) a control button for each of the relative matching graphs allowing the user to value zoom-out;

(g) a control button for each of the relative matching graphs allowing the user to scroll up along each relative matching graph;

(h) a control button for each of the relative matching graphs allowing the user to scroll down along each relative matching graph;

(i) a control button to add stratigraphic cross sections to the wellbore profile;

(j) a control button to delete stratigraphic cross sections from the wellbore profile;

(k) a first indicator to identify dipping away from the projected path;

(l) a second indicator to identify dipping towards the projected path;

(m) a first navigation control for moving the portion of interest in the stratigraphic section in a first direction along the stratigraphic cross section;

(n) a second navigation control for moving portion of interest in the stratigraphic section in a second direction along the stratigraphic cross section;

(o) a legend showing: a planned wellbore, an actual wellbore, formation names, a current formation name, a next formation name, total gas curves, gamma ray curves, or other curves;

(p) at least one speed control button to control a rate of adjustment for at least one of the control buttons; and (q) combinations thereof.

6. The method of claim 4, further comprising plotting as the actual curve: a gamma ray curve, a total gas curve, a geologic curve, a seismic curve, or combinations thereof.

7. The method of claim 4, further comprising presenting a toolbar within the executive dashboard allowing the user to perform tasks, wherein the toolbar includes a member of the group consisting of:

(a) a job management menu that allows the user to choose at least one of the following options: new, open from local database, open from file, close, edit job information, save/export job to file, and exit program;

(b) a report generation menu that allows the user to choose at least one of the following options: create a PDF report or create a rich text format report;

(c) a tops button to produce a drop down menu allowing the user to edit type logs and edit prognosed tops tables;

(d) a survey button that allows the user to choose at least one of the following: edit a planned survey or edit the actual survey;

(e) a stratigraphy button that permits the user to edit stratigraphy adjustments to cause the correlation of the actual curve to the type log curve;

(f) a curve button that enables the user to perform editing of continuous curves in the wellbore profile;

(g) an update button that allows the user to update data from data sources in a synchronized manner;

(h) a configure button that allows the user to select at least one of the following: formations, curves, data sources, data source mappings, alarms, number of days left on a license key, and information on validity of a license key;

(i) a help button that allows the user to type questions and receive answers based on key words within the questions; and (j) combinations thereof.

8. The method of claim 4, further comprising presenting controls within the executive dashboard that allow the user to correlate the actual curve to the type log curve including controls that allow the user to:

(a) adjust a width of the portion of interest in the stratigraphic section; and (b) adjust true vertical depth offset and the dip angle using the control buttons such that the actual curve overlays the type log curve to achieve the correlation.

9. The method of claim 1, further comprising including within the actual survey a member of the group consisting of: a measured depth, an inclination, an azimuth, a tool type, a survey table name, a proposed azimuth, a target angle, a survey calculation method, a target true vertical depth, an initial true vertical depth, an initial vertical section, an initial northing, an initial easting, and combinations thereof.

10. The method of claim 1, further comprising including within both the offset/type table and the prognosed tops table a member of the group consisting of:

(a) a table identifier that identifies offset/type tops being stored in the offset/type table or the prognosed tops table;

(b) a formation name column;

(c) a top depth of formations column;
(d) a true vertical depth tops column;
(e) a true vertical depths base column;
(f) a subsea true vertical depth tops column;
(g) a subsea true vertical depth base column;
(h) a thickness of formation column;
(i) a first selector button that allows the user to enter true vertical depths into the top depths of formations column;
(j) a second selector button that allows the user to enter subsea true vertical depths into the top depths of formations column;
(k) a save and close button that allows the user to save data into the data storage that has been edited in the tables and remove the table from the display;
(l) a save button that allows the user to save data that has been edited in each of the tables;
(m) a close button that allows the user to remove each of the tables from the display; and
(n) combinations thereof.

11. The method of claim 1, further comprising:
(a) computing the plurality of true vertical depths as measured at the perpendicular angle from the horizontal plane representing the surface surrounding the wellbore using measured depths, inclinations, and azimuths;
(b) plotting the plurality of true vertical depths versus measured depths of the drill bit; and
(c) presenting the plotted true vertical depths versus the measured depths within the wellbore profile in the executive dashboard.

12. The method of claim 1, further comprising transmitting an alarm if continued drilling in a formation: will violate a permit, will pose a safety hazard, will be an economic hazard, or combinations thereof, wherein the alarm is transmitted to the client device of the user.

13. The method of claim 1, further comprising superimposing the projected path over a formation structure map of the projected formation, and using the superimposed projected path over the formation structure map to determine faults through which the projected path is expected to pass.

14. The method of claim 1, further comprising superimposing the projected path over the stratigraphic cross section, and using the superimposed projected path over the stratigraphic cross section to determine at least one projected formation through which the projected path is expected to pass.

15. The method of claim 1, further comprising forming a report of the projected path and the actual drilling path, and presenting the report of the projected path and the actual drilling path in the executive dashboard to be viewed in real-time by a plurality of users simultaneously.

16. The method of claim 15, further comprising presenting current information within the executive dashboard for simultaneous display to the plurality of users, and including within the current information:
(a) a current measured depth;
(b) a current formation name;
(c) a next formation name;
(d) a distance to the next formation;
(e) an estimated subsea depth of the next formation;
(f) a current dip;
(g) a current true vertical depth; and
(h) a current subsea true vertical depth.

17. The method of claim 1, further comprising:
(a) forming a report of past drilling data and planned drilling actions;
(b) presenting the report of past drilling data and planned drilling actions within the display; and
(c) including within the report of past drilling data and planned drilling actions:
(i) at least one formation name;
(ii) at least one projected top of the formation associated with the formation name;
(iii) at least one true vertical depth as drilled;
(iv) at least one difference between a projected top and an as drilled top;
(v) at least one dip for the formation name as drilled at a top of a formation;
(vi) at least one drill angle of the wellbore at the top of the formation with a drilled top;
(vii) at least one estimated distance needed for the drill bit to travel at a known drill angle to reach a top of a next formation at a known dip, or to reach a top of a selected formation at the known dip; and
(viii) at least one estimated/actual subsea formation depth relative to sea level of the current formation, the next formation, or the selected formation.

18. The method of claim 17, further comprising including within the report of past drilling data and planned drilling actions: a job number; a well number; a country, a county, or combinations thereof; a kelly bushing elevation; a field name; a start date for drilling; a start depth for drilling; an American Petroleum Institute number; a state in which the drilling occurs; a ground level elevation; a unit number; an end date of drilling; and an end depth of the drilling.

19. The method of claim 1, further comprising displaying in the executive dashboard an actual location of the drill bit on the actual drilling path in the wellbore profile for instantaneous identification of the drill bit.

20. The method of claim 1, further comprising:
(a) plotting the subsea true vertical depth against: the true vertical depth, the start measured depth, and the ending measured depth; and
(b) including the plot of the subsea true vertical depth within the wellbore profile.

21. The method of claim 1, further comprising determining the projected formation using a geological hypothesis of an actual geological formation.

22. The method of claim 1, wherein the geological prognosis includes a stratigraphic map with a member of the group consisting of: header information; payzones; formation information; top depths of formations; base depths of formations; a target line; and combinations thereof.

23. The method of claim 1, further comprising:
(a) generating the geological prognosis using a surface elevation or a rotary table bushing elevation of the surface for a start of the wellbore and at least one offset/type top of the projected formation; or
(b) allowing the user to provide the geological prognosis.

24. The method of claim 1, further comprising using offset/type log tops from a vertical well proximate the wellbore to calculate thicknesses of formations, thicknesses of rock between formations, other geological features, or combinations thereof.

25. The method of claim 1, further comprising including a type log in each of the plurality of offset/type tops.

26. The method of claim 1, further comprising:
(a) generating the projected path by calculating the projected path using a kick off point, a build rate, a landing point, and a target angle; or
(b) allowing the user to provide the projected path.

27. The method of claim 1, further comprising providing correlation points for at least one actual curve or at least one point along the actual curve of the stratigraphic cross section, and tying each correlation point to a known type log curve for confirming: accuracy of the actual curve, accuracy of a fit of the actual curve to the known type log curve, or combinations thereof.

28. The method of claim 27, further comprising allowing the user to thicken or thin each actual curve within the portion of interest of the stratigraphic section to fit the known type log curve.

29. The method of claim 1, wherein the user is a computer.

30. The method of claim 1, further comprising:

(a) presenting the projected path in the executive dashboard simultaneously in two dimensions and in three dimensions, wherein the three dimensional presentation of the projected path includes an overlay of an ownership map and a microseismic plot along an azimuth of the wellbore;

(b) storing the received data from the directional drilling equipment within a data storage;

(c) communicating over a network and importing the plurality of offset/type tops of the projected formation through which the projected path will follow into the data storage;

(d) saving the wellbore profile in the data storage;

(e) transmitting the wellbore profile to the display;

(f) computing a distance to next formation using measured depth from a current formation, and presenting the computed "distance to next formation" to the user within the executive dashboard;

(g) computing an estimated subsea depth of next formation using an estimated true vertical depth of a next formation and a kelly bushing elevation, and presenting the "estimated subsea depth of next formation" to the user in the executive dashboard;

(h) determining a current dip angle of a current formation;

(i) enabling the user to increase or decrease values associated with each control button to modify: the start measured depth, the ending measured depth, the true vertical depths offset, the dip angle, or combinations thereof for portion of interest in the stratigraphic section to correctly identify a location of the drill bit in the stratigraphic cross section;

(j) configuring the executive dashboard to allow the user to highlight portions of the wellbore profile;

(k) calculating a current true vertical depth, and presenting the "current true vertical depth" in the executive dashboard;

(l) presenting the report to the user in addition to and simultaneously with the executive dashboard; or (m) combinations thereof.

* * * * *